US007543647B2

(12) United States Patent
Walker

(10) Patent No.: US 7,543,647 B2
(45) **Date of Patent: *Jun. 9, 2009**

(54) MULTI-ZONE, SINGLE TRIP WELL COMPLETION SYSTEM AND METHODS OF USE

(75) Inventor: David J. Walker, Lafayette, LA (US)

(73) Assignee: BJ Services Company, Houston, TX (US)

( * ) Notice: Subject to any disclaimer, the term of this patent is extended or adjusted under 35 U.S.C. 154(b) by 21 days.

This patent is subject to a terminal disclaimer.

(21) Appl. No.: 11/615,529

(22) Filed: Dec. 22, 2006

(65) Prior Publication Data

US 2007/0163781 A1 Jul. 19, 2007

Related U.S. Application Data

(63) Continuation-in-part of application No. 11/418,765, filed on May 6, 2005, now Pat. No. 7,490,669.

(60) Provisional application No. 60/763,246, filed on Jan. 30, 2006, provisional application No. 60/678,689, filed on May 6, 2005.

(51) Int. Cl.
*E21B 43/00* (2006.01)

(52) U.S. Cl. ..... 166/313; 166/381

(58) Field of Classification Search ..... 166/313, 166/381

See application file for complete search history.

(56) References Cited

U.S. PATENT DOCUMENTS 4,270,608 A 6/1981 Hendrickson et al.
4,273,190 A 6/1981 Baker et al.
4,401,158 A 8/1983 Spencer et al.
5,579,844 A * 12/1996 Rebardi et al. ..... 166/296
5,921,318 A 7/1999 Ross
6,397,949 B1 6/2002 Walker et al.
6,464,006 B2 10/2002 Womble
6,722,440 B2 4/2004 Turner et al.
7,152,678 B2 12/2006 Turner et al.
7,198,109 B2 4/2007 Turner et al.
2002/0117301 A1 8/2002 Womble
2004/0238173 A1 * 12/2004 Bissonnette et al. ..... 166/307

FOREIGN PATENT DOCUMENTS

WO WO2004/063527 A1 7/2004

OTHER PUBLICATIONS

Search Report for corresponding International Patent Application No. PCT/US2007/068182.
Written Opinion for corresponding International Patent Application No. PCT/US2007/068182.
Office Action from related U.S. Appl. No. 11/418,765.

* cited by examiner

*Primary Examiner*—Giovanna C Wright
(74) *Attorney, Agent, or Firm*—Zarian Midgley & Johnson PLLC

(57) ABSTRACT

An improved well completion system for completing two or more separate production zones in a well bore during a single downhole trip is disclosed. The improved completion system comprises a completion assembly comprising two or more production zone assemblies and a completion tool assembly. Each production zone assembly may comprise an automatic system locating assembly and at least two inverted seal systems for sealing against the tool assembly.

20 Claims, 17 Drawing Sheets

MULTI-ZONE, SINGLE TRIP WELL COMPLETION SYSTEM AND METHODS OF USE

CROSS REFERENCE TO RELATED APPLICATIONS

This application for patent is a continuation-in-part of U.S. patent application Ser. No. 11/418,765, filed on May 5, 2006, which claims benefit of and priority to U.S. Provisional Patent Application Ser. No. 60/763,246, filed on Jan. 30, 2006, and U.S. Provisional Patent Application Ser. No. 60/678,689, filed on May 6, 2005. Each of the foregoing are incorporated by reference herein for all purposes.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The inventions described herein relate generally to hydrocarbon well completion systems, and more particularly to a system for completing multiple production zones in a single trip.

2. Description of the Related Art

One of the single biggest costs associated with completing a subterranean hydrocarbon well, such as a sub sea well, is the time that it takes to remove a tool or other well equipment from the well bore. Depending on well depth, tripping time may account for the majority of well completion costs. For a well having multiple production zones, tripping time is compounded if each zone must be completed separately from the other zones. It is desirable, therefore, to reduce the number of trips necessary to complete the two or more production zones in a multi-zone well.

U.S. Pat. No. 6,464,006 is entitled Single Trip, Multiple Zone Isolation, Well Fracturing System and discloses a device and method for "the completion of multiple production zones in a single well bore with a single downhole trip."

U.S. Pat. No. 4,401,158 is entitled One Trip Multi-Zone Gravel Packing Apparatus and discloses a device and method for "gravel packing a plurality of zones within a subterranean well . . . whereby each successive zone may be gravel packed by successively moving the" equipment.

The inventions disclosed and taught herein are directed to improved systems and methods for completing one or more production zones in a subterranean well during a single trip.

BRIEF SUMMARY OF THE INVENTION

In one implementation of the invention, a method of completing two or more production zones with an improved well completion system in a single downhole trip is provided and may comprise assembling a plurality of production zone assemblies so that each assembly comprises a production screen assembly having at least one production screen valve. Running the production zone assemblies in the well on production tubing. Locating a completion tool assembly in a lowermost production zone assembly, wherein the tool assembly may have a deactivated opening tool that is activated after the tool has passed below a last production screen valve. Assembling a production packer assembly comprising a setting tool to the production zone assemblies to form a completion assembly. Running the completion assembly and tool assembly into position established by a sump packer. Cycling the tool assembly within a production zone assembly to index the completion system to a formation treatment condition and treating the production zone.

In another implementation of the invention, a single trip well completion system is provided that may comprise: a completion assembly comprising a plurality of production zone assemblies corresponding to formation zones in the well. A completion tool system adapted to operate within the completion assembly. An automatic completion system locating assembly operable between a production assembly and the tool system to cycle the completion system between a plurality of operating conditions and a tool activation assembly disposed in a lowermost production zone assembly to activate a deactivated opening or closing tool on the tool system.

Yet another aspect of the invention comprises setting a sump packer; perforating one or more zones as needed; making up and pressure testing each production zone assembly and service tool at rig floor; running in the production assembly on a work string or production tubing and locating the assembly on the sump packer; setting a top production/gravel pack packer; releasing a service tool, if the production assembly was run in on a work string, or otherwise running in a service tool; opening a lower zone screen wrapped production sleeve and testing the system; locating a Frac/gravel pack position and setting a lower zone isolation packer; opening a lower zone Frac pack sleeve and locating a Frac/gravel pack position; fracturing the lower zone; picking up and reversing out; closing all lower zone sleeves; pressure testing for isolation; beginning next zone completion by opening lower zone screen wrapped production sleeve and testing; repeating the completion process until the last zone is completed; running production seals into upper production packer, if needed; and opening sleeves as needed for production.

DETAILED DESCRIPTION

Figure 1:
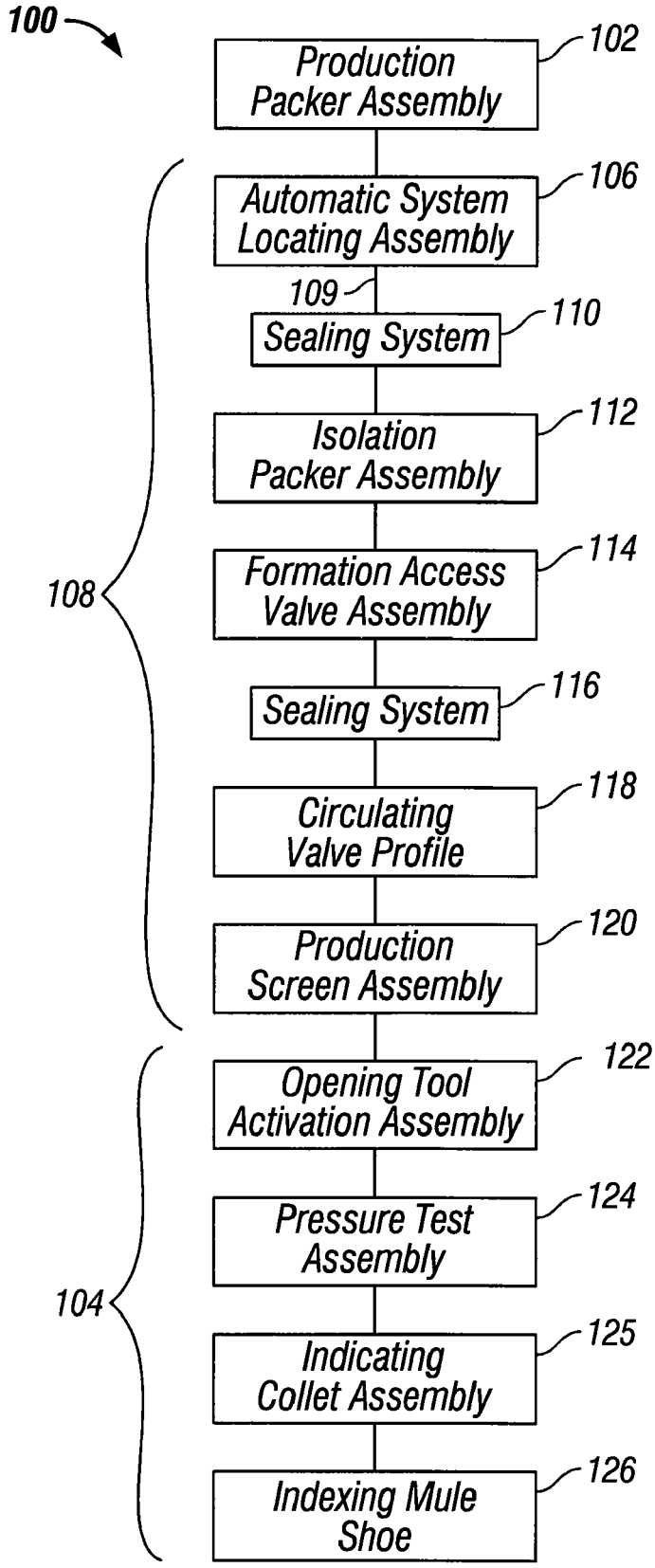
FIG. 1 illustrates an arrangement for a completion assembly having two or more production zone assemblies for use with the improved well completion system.

The Figures described above and the written description of specific structures and processes below are not intended to limit the scope of what Applicants have invented or the scope of protection for those inventions. The Figures and written description are provided to teach any person skilled in the art to make and use the inventions for which patent protection is sought. Those skilled in the art will appreciate that not all features of a commercial implementation of the inventions are described or shown for the sake of clarity and understanding. Persons of skill in this art also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill this art having benefit of this disclosure. The inventions disclosed and taught herein are susceptible to numerous and various modifications and alternative forms.

The use of a singular term is not intended as limiting of the number of items. Also, the use of relative terms, such as, but not limited to, "top," "bottom," "left," "right," "upper," "lower," "down," "up," "side," and the like are used herein for clarity in reference to the Figures and are not intended to limit the invention or the embodiments that come within the scope of the appended claims. "Uphole" generally refers to the direction in which equipment is tripped out the well. "Downhole" generally refers to the direction that is the opposite of uphole for a particular well. The improved well completion systems disclosed and taught herein may be used in vertical wells, deviated wells and/or horizontal wells.

Applicants have created an improved system for completing in a single downhole trip one or more hydrocarbon bearing formations (production zones) traversed by a well bore. The improved well completion system accomplishes multiple tasks in a single downhole trip and provides for well bore operations, such as, but not limited to, formation fracturing and gravel packing operations, squeeze and circulating conditions, and real time annulus pressure monitoring, all with no production zone length restriction. The improved well completion system may comprise a completion assembly comprising two or more production zone assemblies and a production packer, and a service tool assembly.

The improved well completion system may be pressure tested before pumping operations begin. Preferably, a wash pipe is not required during formation treatments, such as, but not limited to, fracturing or gravel packing operations. Positive, selective production zone isolation is provided during completion, stimulation, and production operations and the improved well completion system provides for fresh isolation seals for each zone. The improved well completion system provides physical indications of some or all system positions or conditions, with optional hydraulic verification as well.

Conventional mechanical sleeve valves may access hydrocarbon production from one or more selected production zones. Additionally, multi-zone production control systems, such as, but not limited to, those disclosed in commonly owned U.S. Pat. Nos. 6,397,949, 6,722,440, and pending application Ser. Nos. 10/364,941 and 10/788,833, (the disclosure of each being hereby incorporated by reference for all purposes) may be incorporated with the improved completion system to allow non-commingled production from two or more zones that were completed in a single downhole trip.

In general, once the well bore has been established and is ready for completion, a conventional or proprietary sump packer may be run into the well bore to a predetermined depth and set in place. Typically, the sump packer will be used to provide a reference point for subsequent well operations, such as, but not limited to, zone perforation and completion. If desired, conventional or proprietary perforating operations may be employed to sequentially or simultaneously perforate one or more of the production zones of interest traversed by the well bore. The improved well completion system imposes no restrictions on the length of a production zone or on the spacing between zones. If necessary, fluid loss control systems, such as, but not limited to, but not limited to pills, may be used to control the perforated zones. Once the production zones of interest have been established, an improved completion system utilizing one or more aspects of the present inventions may be assembled.

An improved completion system may comprise a completion assembly, which may comprise a bottom assembly, two or more production zone assemblies and a production packer.

The completion assembly may be assembled and hung off the rig floor. A bottom assembly may comprise a indicating collet assembly for indicating position off of the sump packer; a pressure test assembly allowing internal pressurization for integrity testing purposes, and a tool activating assembly to activate a deactivated tool assembly, if used. The two or more production zone assemblies may comprise a production screen assembly with internal production valves, such as, but not limited to, mechanical sleeves for sealing and unsealing production screen ports, a circulation valve closing profile, formation access valve assembly, a seal system, an isolation packer assembly and an automatic system locator assembly. The bottom assembly may be coupled to a first or lower production zone assembly, both of which may be hung off the rig floor and pressure tested during make up.

Typically, each successive production zone assembly, if used, may comprise substantially the same components as the first or lower production zone assembly, or the successive production zone assemblies may comprise components different that than the first production zone assembly or other production zone assemblies, as required by the particulars of the well and production zones. Preferably, each production zone comprises isolated gravel pack screens, preferably with integral production sliding sleeves, a frac pack/gravel pack sleeve for placing sand or proppant, a seal system, an automatic system locating assembly and an isolation packer. As each successive production zone assembly is made up, the completion assembly is hung off the rig floor and pressure tested for integrity. All system valves, such as, but not limited to, production valves, may be, and preferably are, run in the closed position to provide positive, pre-treatment zonal isolation. Once the desired number of production zone assemblies are made up and hung off the rig floor, a single gravel pack service tool may be installed below the lowermost screened interval and connected through a concentric inner work string to the primary work string above the top production packer. Alternately, the assembly may be run into the well on production tubing and the work string/service tool may be installed below the lowermost screened interval thereafter. In any event, the entire assembly may be run into the wellbore in a single trip.

A service tool assembly for use with the improved well completion system may comprise a nosepiece, an opening tool assembly, a secondary indexing collet assembly, a closing tool assembly including a circulation valve, a cross-over assembly with hardened seal surfaces and a primary indexing shoulder, an automatic system locating profile and a hydraulic setting tool. For completion assemblies that utilize the typical down-to-open convention for production valves, the opening tool preferably will be located distally of the closing tool. The service tool assembly may comprise hardened seal surfaces, such as slick joints, that cooperate with the seal systems in each production zone assembly to provide a positive sealing system for each zone to be completed.

In some embodiments, prior to final improved completion system make-up, the service tool assembly may be run into the completion assembly and positioned such that the opening tool (and/or the closing tool, as desired) is located below the lowermost production sleeve in the first or lowermost production zone assembly. Once the tool assembly has been positioned within the lowermost production assembly, a completion system pressure test may be run to verify overall system integrity, including that all system valves are closed. To ensure that running the service tool assembly through the production zone assemblies has not unintentionally opened one or more down-to-open valves, the opening tool may be initially deactivated, such as during run in. In a preferred embodiment, once the service tool assembly has been positioned with the completion assembly, the opening tool may be activated by hydraulic pressure. Alternately, positioning the service tool with the completion assembly may mechanically activate the opening tool. If desired, a device may be provided to allow for verification that the opening tool has been activated, such as, but not limited to, a mock mechanical sleeve. After pressure integrity testing has been completed, the pressure test sub in the lowermost assembly may be deactivated, such as, but not limited to, by using the nose piece of the tool assembly to removing a sealing device.

An improved well completion system (e.g., comprising two or more production zone assemblies and a service tool assembly) may be run into to the well bore, on a work string or production tubing, and located in position relative to the sump packer or other well bore artifact. In a preferred embodiment, the lowermost production zone assembly comprises a position indicating system, such as, but not limited to, an indicating collet assembly. For example, once the improved completion system is believed to be correctly positioned relative to the sump packer, the indicating system may provide positive placement identification, such as, but not limited to, by a repeatable lifting or "snap through" load. Once the improved completion system is properly located, with or without the aid of a position indicating system, a production packer may be set according to its design. For example, the production packer may comprise a BJ Services CompSet II HP packer, which may be hydraulically set, such as by dropping a ball or other pressurization device into the completion system and pressuring up against the device. This pressurization may be used to activate the hydraulic setting tool to set the packer, and thereafter release the service tool assembly and work string from the completion assembly (e.g., the production packer).

In such embodiments, once the service tool assembly has been separated from the completion assembly, any pressure-blocking device used to activate the setting tool may be disabled. In the case of the CompSet II HP production packer, additional pressurization against a ball will move the ball out of setting tool activating position and simultaneously uncover the crossover ports in the service tool assembly and trap the ball against unwanted upward travel. Alternately, the ball may comprise polymer glass-filled lightweight ball that may be reversed out of the system, thereby eliminating the need for a "mouse trap" to capture and hold the setting ball.

Alternately, the TIP-PT Packer available from BJ Services Company is suitable for use with the present invention when the production assemblies are run in on the production tubing, rather than a work string.

Regardless of whether the production assemblies were run in on a work string or production tubing, the service tool assembly may be moved relative to the completion assembly to position the opening tool above a production valve, such as, but not limited to, a down-to-open production sleeve in the first or lowermost production zone assembly. Once the opening tool is positioned above the production valve, downward movement of the service tool assembly will cause the opening tool to engage a corresponding opening profile on the production valve and open the associated production ports, such as, but not limited to, by moving a production sleeve. Opening of the production ports may be verified hydraulically by pumping down the well bore and into the formation.

The service tool assembly also may be moved adjacent the isolation packer assembly for the lowermost production zone to engage the production assembly's seals with tool assembly's hardened seal surface. Once the seal surface or slick joint is positioned in sealing arrangement, the isolation packer may be set, such as, but not limited to, by pressuring down the work string. Once the pressure integrity of the lowermost isolation packer is established, the tool assembly may be re-positioned so that the opening tool is in position to open (e.g., above) a formation access valve or frac valve in the production zone assembly. The service tool assembly may be repositioned to open the formation access valve and to position the tool assembly for well treatment operations. In a preferred embodiment, each production zone assembly comprises an automatic locating assembly or "autolocator" that may be cycled by the service tool assembly among a plurality of well completion system conditions, such as, but not limited to, "Run-In," "Set-down" and "Pick-Up."

In a preferred embodiment, once the service tool assembly cycles the autolocator to the "Set-down" or frac condition, set down weight may be applied to the well completion system to maintain relative position between the service tool assembly and the completion assembly (e.g., to maintain port alignment) during pumping treatments. The improved well completion system may also provide for real time pumping pressures to be monitored through the annulus during pumping operations. The well completion system may be placed in a squeeze position at any time during the pumping operation by simply repositioning the well tool assembly.

A formation fracturing and/or gravel packing operation may be applied by pumping down the work string and into the annulus adjacent the production screen assembly. Once the treatment is completed, the service tool assembly may be repositioned to a reverse position by locating the crossover assembly relative to the reversing seal in the production zone assemblies. Debris from the gravel packing treatment may be reversed out of the completion system by pumping down the tool assembly annulus and taking returns up through the work string. The pressures developed during reversing will not affect formation zones above the zone being completed because such upper zones are fully isolated and their production ports are closed. The tool assembly is once again repositioned so that the end of the tool assembly is above the formation access seal to clear any remaining debris. The formation may be monitored thereafter for pressure build up or fall off.

The tool assembly may be repositioned so that the closing tool is located distal or below the lowermost opened production valve. Upward movement of the tool assembly through the zone causes the closing profile on the closing tool to engage a corresponding profile on the production valve, (e.g., a production sleeve) and causes all production valves to seal off or close their associated production ports, thereby isolating the completed zone. Zone isolation may be verified by surface pressurization.

The service tool assembly may then be repositioned into the zone above the zone just completed. The opening tool may be positioned above or proximal a production sleeve in this zone. The process described above may be repeated for each successive production zone. Once all production zones have been completed, the service tool assembly and work string may be removed from the well bore leaving a completed, fully isolated, multi-zone well. Production of hydrocarbons from any zone may be accomplished by mechanically opening the desired production valves using wire line, coiled tubing or other conventional or proprietary methods. Commingled production from multiple zones may be accomplished by opening production sleeves in multiple zones. A preferred embodiment of the completion system contemplates a selective profile system having four, five, six or more different production sleeve profiles for selective zonal production. For example, specific profiles on the service tool assembly may open and/or close valves in the completion assembly. Other specific profiles associated with coiled tubing tools and/or wire line tools may be used to selectively open and/or close such valves. Also, when coupled with intelligent or interventionless production control systems, such as, but not limited to, those commonly-owned systems referenced above, the improved completion system disclosed herein may provide simultaneous, non-commingled production from multiple zones without mechanical intervention, or a combination of mechanical and hydraulic interventions.

An improved completion system utilizing one or more the present inventions may reduce or eliminate the need to run and/or retrieve packer plugs and/or gravel pack assemblies, and may eliminate multiple perforation runs. Substantial savings in rig time and money, as well as responsible formation management, may be realized by virtue of one or more of the present inventions disclosed and taught with this improved completion system.

FIG. 1 is an illustration of one of numerous embodiments of a completion assembly 100 for use with an improve completion system incorporating one or more of the inventions disclosed herein. The uppermost portion of the completion assembly 100 may comprise a production packer assembly 102. A preferred packer assembly is the CompSet II HP Packer or the TIP-PT Packer, both offered by BJ Services Company of Houston, Tex. The first of one or more production zone assemblies 108 is also represented.

A production zone assembly 108 may comprise an automatic locating assembly 106 to locate positively the completion system in its several conditions, such as, but not limited to, a "Frac/Set Down" position, a "Pickup" position, and a "Run-in" position. The automatic locating assembly or "autolocator" 106 preferably comprises a debris barrier, such as, but not limited to, a molded rubber cup positioned above the autolocator 106 and engaging the casing or well bore for preventing or reducing the amount of debris from collecting in the autolocator 106. In addition, a quick union may be interposed between the production packer assembly 102 and the topmost production zone assembly 108 so the completion assembly 100 does not have to be rotated after the tool assembly 200 is positioned therein. Also in each production zone assembly 108, it is preferred to place a shear-out safety joint 109 (e.g., FIG. 5*b*) in case the completion system becomes stuck. A mechanical shear out safety joint or a hydraulically actuated safety joint may be employed. It is preferred to locate the safety joint above the first sealing system 110 and below the autolocator 106. A running groove may also be provided in each production zone assembly to facilitate hanging the assemblies off the rig floor.

Figure 2:
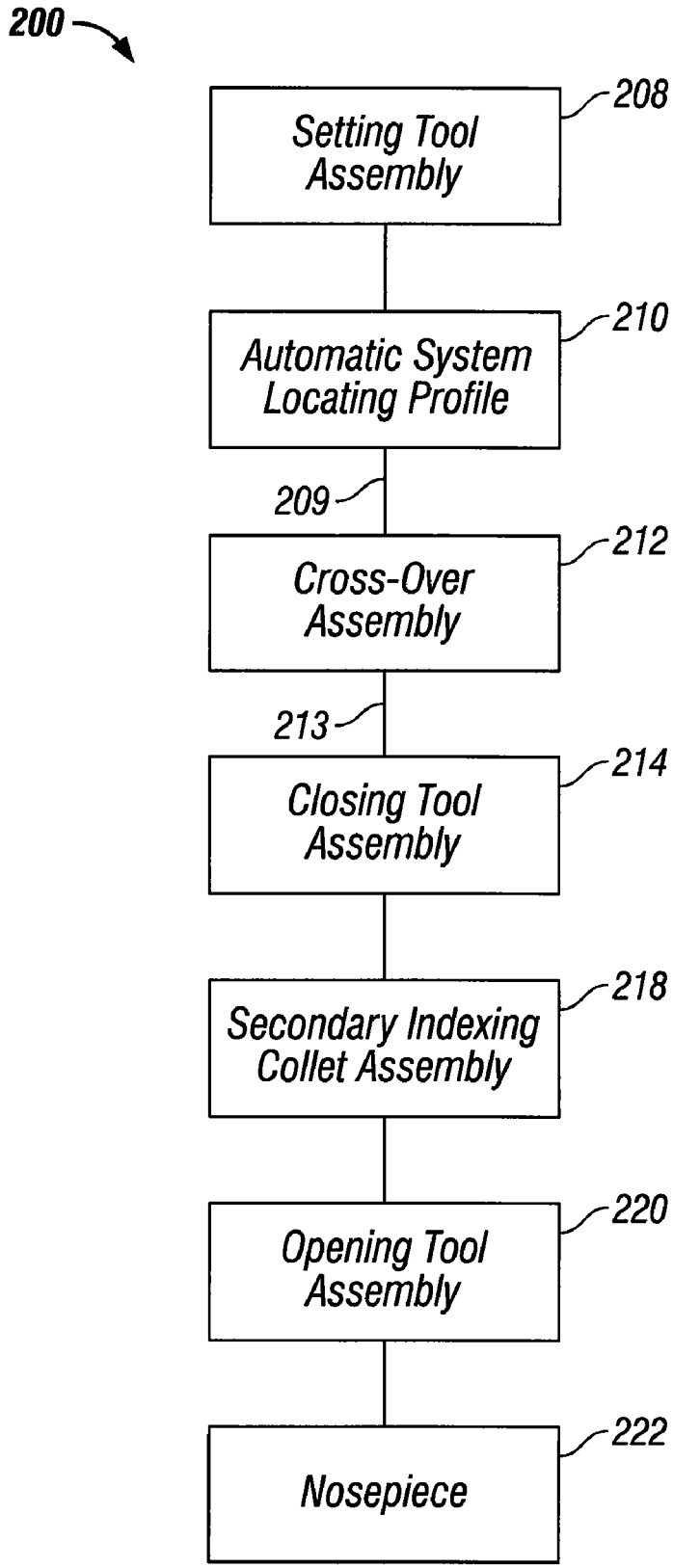
FIG. 2 illustrates an arrangement for a service tool assembly for use with the improved well completion system.

A first sealing system 110 is provided for sealing against selected portions of the service tool assembly (FIG. 2). An isolation packer assembly 112 may be provided to isolate the production zone of interest. A formation access valve assembly 114, or frac pac window, may be formed in the production zone assembly 108 to control fluid communication between an inside of the production zone assembly 108 and the outside of the assembly (or annulus, not shown). A second sealing system 116 is provided such that the formation access valve assembly 114 is disposed between the first and second sealing systems 110, 116. A preferred sealing system comprises the inverted molded seals described herein. A circulation valve closing profile 118 may be provided to, for example, close a circulation valve in the completion tool assembly when the completion system is cycled from the fracturing operating condition position to the reversing position. Lastly, a production screen assembly 120 comprising one or more production screens (not shown) and associated production screen valves (not shown), such as, but not limited to, mechanical sleeves, may be provided.

Coupled to the first or lower production zone assembly 108, is a bottom assembly 104. The bottom assembly 104 may comprise an opening tool activating assembly 122 to activate an opening tool and/or closing tool on the service tool assembly, if such tool or tools have been deactivated. The activating assembly may also provide a positive stop for positioning the service tool assembly (FIG. 2). A pressure test assembly 124 may be provided to facilitate pre-installation pressure testing of the completion assembly 100. Lastly, an indicating collet assembly 125 and an indexing mule shoe 126 may be provided to finish off the completion assembly 100. In some embodiments, the completion assembly 100 may be run in the well on the actual production tubing. Alternately, as discussed below, the completion assembly 100 may be run in on a work string/service tool assembly.

FIG. 2 is a representation of a service tool assembly 200 that may be used with the completion assembly 100 of FIG. 1. The service tool assembly 200 may comprise a conventional or proprietary hydraulic setting tool 208, an automatic locating profile 210, which is adapted to interface with automatic locating assembly 106 in the completion assembly 100. It will be appreciated that if the completion assembly 100 is run in on production tubing, the setting tool 208 may be omitted. A cross-over assembly 212 comprising seal surfaces, such as nitrided slick joints 209, 213, above and below a cross-over port may be provided to facilitate fluid communication from inside the tool assembly 200 to the outside, and to seal against the completion assembly seal systems 110, 116 in each production zone assembly 108. The upper end of the top most seal surface may comprise a primary indexing shoulder for interacting with the automatic locating assembly 106. A closing tool assembly 214 comprising a circulation valve 216 maybe provided having one or more structures or profiles for engaging and closing corresponding structures on various valves in the completion assembly 100. The circulation valve 216 may control fluid communication along the interior of the tool assembly 200. A secondary indexing collet 218 may be provided to activate the automatic locating assembly ("autolocator") 106 in certain conditions. An opening tool assembly 220 is provided having one or more structures or profiles for engaging and opening corresponding structures on various valves in the completion assembly 100. The opening tool assembly 220 is preferably deactivated on initial run in and thereafter activated once the tool assembly 200 is in position within the completion assembly 100 by opening tool activation assembly 122. Lastly, a nosepiece 222 may complete the service tool assembly 200.

Figure 3:
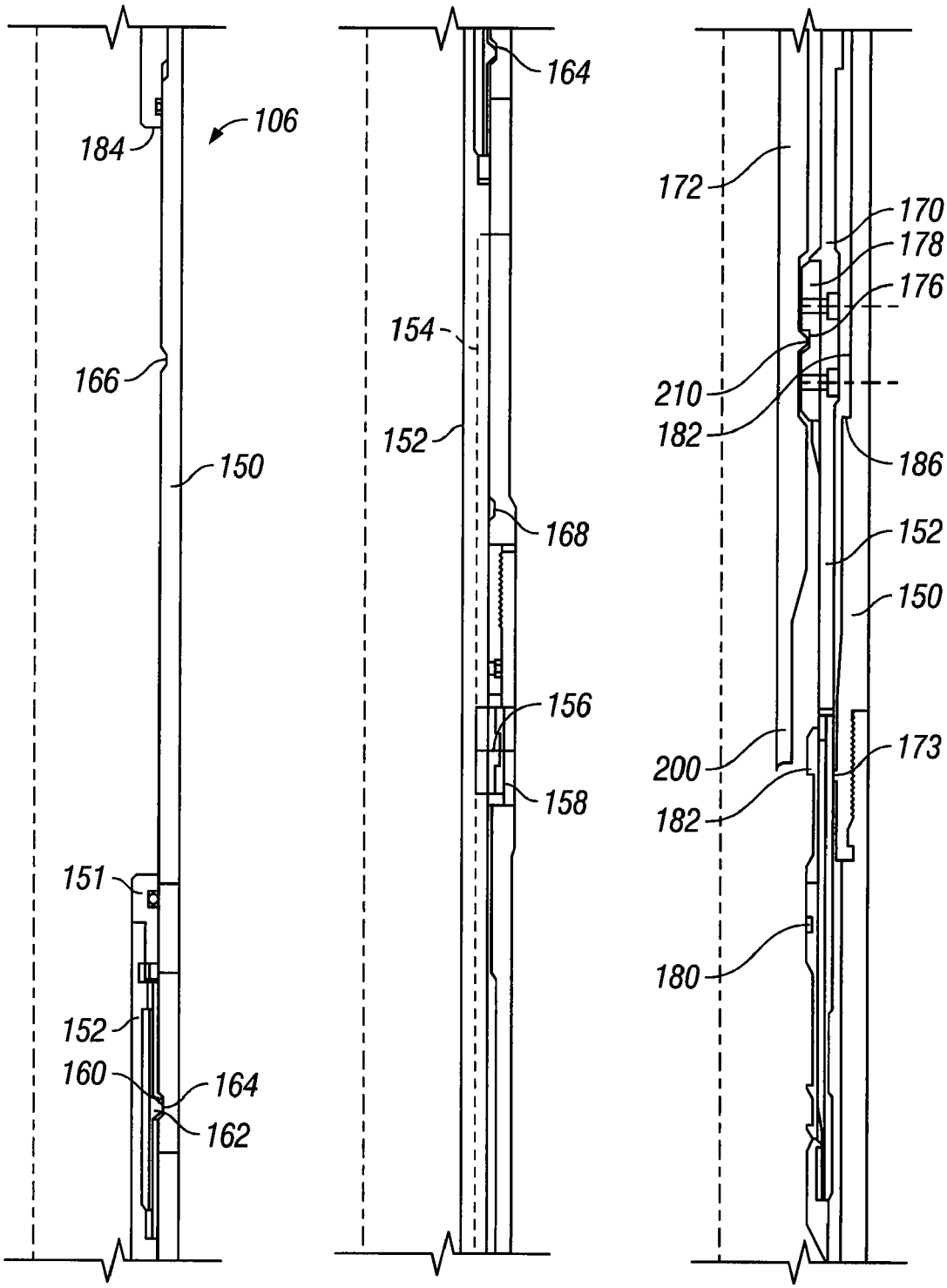
FIG. 3 illustrates a cross-sectional side view of an automatic position locating assembly for use with the improved well completion system.

Turning now to a more detailed description of embodiments and preferred embodiments of the improved completion system, FIG. 3 illustrates a cross-sectional side view of a preferred form of an automatic system locating assembly 106 or "autolocator" that may be used with the improved well completion system of the present invention. The autolocator 106 comprises an outer housing 150 and an inner housing 152. The outer and inner housings are adapted to slide relative to one another and the interface there between comprises an indexing cycle 154 and follower 156. The follower 156 is partially housed within a bearing 158; preferably bronze, to facilitate sliding contact (both axial and circumferential) between the inner and outer housings, 152, 150. The indexing cycle 154 is described in more detail in FIG. 4.

In the particular embodiment of the autolocator illustrated in FIG. 3, a portion of the inner housing 152 comprises a plurality of collet fingers 170, preferably 8. At approximately the mid length of each finger 170 is an autolocator profile or groove 176 adapted to interface with the autolocator profile 210 on the service tool assembly 200. The groove 176 is preferably formed in an insert 178 that is coupled to each collet finger 170. The fingers 170 and autolocator profiles 210, 176 are preferably designed to require a snap through load of about 12 kips in the uphole direction. Because off the relatively high pass through load, it is preferred that the insert 178 be made from a beryllium copper alloy to provide superior anti-galling characteristics. One such alloy suitable for the insert 178 is CDA 172 alloy (ASTM B196). Other material systems that offer suitable galling resistance and strength may be used.

At its proximal end, the inner housing 152 has a floating detent collet 160 comprising a plurality of fingers that are held in place between a shoulder and retaining ring 151. It is preferred that the retaining ring 151 be made from a bearing material, such as bronze. The retaining ring preferably comprises a debris shield to reduce the risk of debris fouling the detent collet assembly 160. The each finger has a profile 162, which corresponds to one or more grooves in the outer housing 150. Preferably, the outer housing 150 has a plurality of detent grooves, which correspond to the various positions or conditions into which the completion system may be placed. For example, detent groove 164 may correspond to a "Run-In" condition, groove 166 may correspond to a "Pick-Up" condition and groove 168 may correspond to a "Frac or Set-down" condition. The detent collet 160 and grooves may be designed for a snap through load of about 1 kip.

As illustrated in FIG. 3, the autolocator 106 is in the "Run-In" condition (i.e., detent profile 162 engages groove 164). When the tool assembly 200 has engaged the autolocator 106 (i.e., when profile 172 is engaged with grooves 176), a load of about 1 kip is required to shift the completion system 100 (or more precisely, the particular production zone assembly 108) into either the "Pick-Up" or "Set-down" condition, depending upon the state of the indexing cycle 154. The same 1-kip load is also required to return to the "Run-In" condition. As can be seen in FIG. 3, when the autolocator 106 is in the Run-In or Pick-Up condition, the collet assembly 170 is able to deflect into recess 182 to allow the serve tool assembly 200 to snap through. To pass the tool assembly 200 through the autolocator 106 in an uphole direction requires a load of about 13 kips. The autolocator 106 is in the Set-down or Frac condition, the collet 170 is displaced downhole relative to outer housing 150 and collet surface 171 will be adjacent outer housing surface 173. In this condition, there is no recess for the collet to expand into and the service tool assembly may not snap through the autolocator in either direction. In the Set-down or Frac condition, the set down weight is carried by the autolocator profiles 210, 176 and set down shoulder 186. It is preferred that in Set-down condition, the collet fingers 170 are always placed in tension to avoid buckling the collet 170.

It is preferred that the autolocator assembly 106 also comprises a lockout mechanism 180, such as a sleeve. The lockout sleeve 180 has closing tool profiles 181, 182 so that the closing tool 214 on the completion tool assembly 200 can engage the lockout sleeve 180 to move it relative to the collet assembly 170. When the closing tool assembly 214 engages profile 181, the lockout mechanism 180 may be moved uphole and cause the collet assembly 170 to deflect outwardly. Therefore, the bearing inserts 178, and profiles 176 are moved out of the way and into recess 182.

Figure 4:
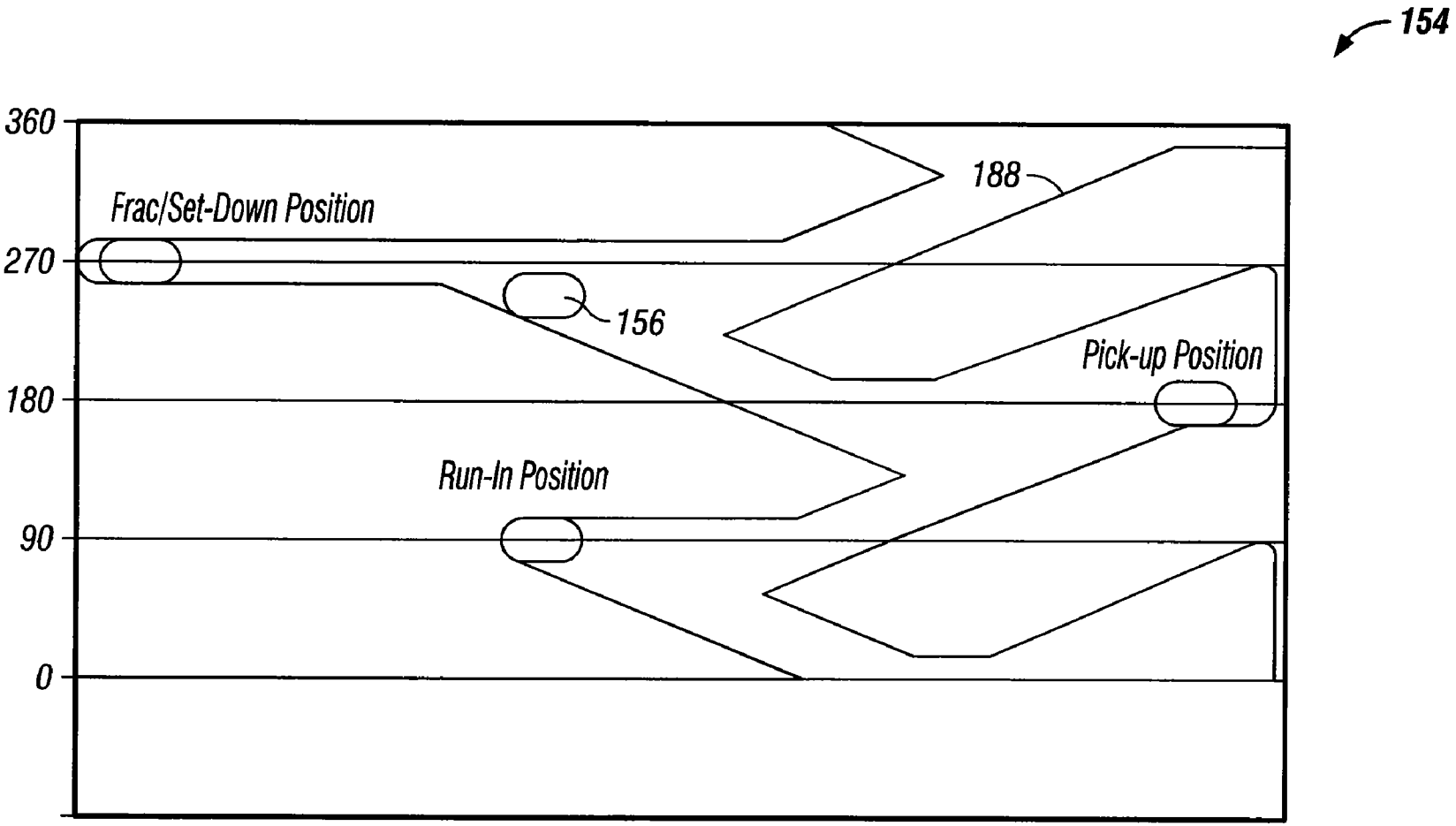
FIG. 4 illustrates a planar view of a 360-degree indexing cycle assembly for use with the automatic position locating assembly of FIG. 3.

FIG. 4 is a laid-out illustration of the preferred indexing cycle 154 for the autolocator 106. One complete cycle is shown in FIG. 4 and it is to be understood that the indexing cycle 154 may be a continuous loop. The indexing cycle 154 comprises an engineered track 188 along which a follower 156 is constrained to travel. Although the follower 156 is shown in FIG. 4 to be in multiple positions along the track, it will be appreciated the follower 156 will reside in only one position along the track 188 at any point in time. For example, while the completion tool assembly 200 is engaged in the autolocator 106 (such as shown in FIG. 3), downhole movement of the work string will cause the completion system to enter the "Frac/Set-down" condition and detent collar 160 will engage detent groove 168. Thereafter, uphole movement of the tool assembly 200 will cause the completion system to enter the "Pick-Up" condition. The follower 156 may comprise a ring carried in a bronze bearing 158, in which the follower 156 may rotate. In a preferred embodiment, the follower 156 is not loaded in the Set-down or Pick-Up conditions, but may be load bearing in the Run-In condition.

In the embodiment described in FIGS. 3 and 4, the autolocator is associated with the completion assembly and the autolocator profile is associated with the service tool assembly. Those of skill in the art will appreciate that this association may be preferred for smaller diameter completion systems. Larger diameter completions may permit this association to be reversed. In other words, the invention described herein also contemplates that the autolocator profile may be associated with the completion assembly and the autolocator may be associated with the service tool assembly.

Figure 5A:
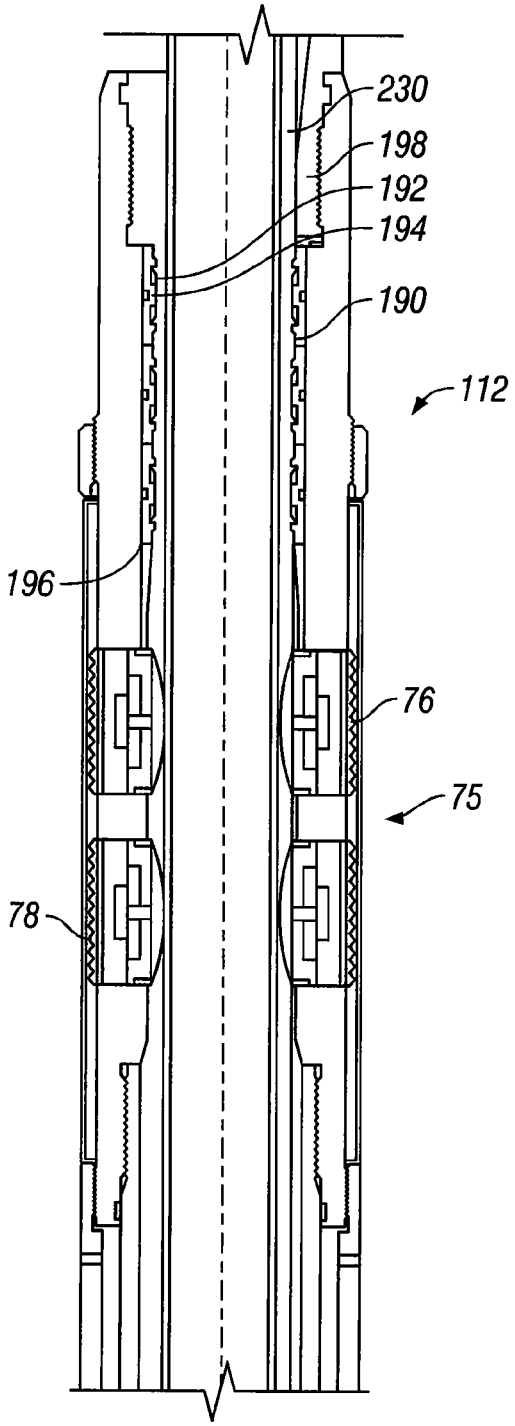
FIG. 5A illustrates a cross-sectional side view of a first inverted seal system for use with the improved well completion system

FIG. 5*a* illustrates generally a first seal system 110 located adjacent an isolation packer assembly 112. In a preferred embodiment, the first seal system is located above the packer setting port. The seals 190 of the first seal system 110 are preferably molded elastomeric seals 192 on a metal carrier 194, although other sealing technologies, such as, but not limited to, PTFE, PEEK and/or PEKK may be used. The seal system 190 may be described as "inverted" in that the sealing surfaces 192 are exposed to the inside of the production zone assembly 108. As shown in FIG. 5*a,* a stack of 3 seal rings may be held in a seal recess 196 by a retainer 198 (which may be a part of a safety joint). The seal system 190 is adapted to sealingly engage a portion of the tool assembly 200, such as, but not limited to, a slick joint 230 or other seal surface. It will be appreciated that each production zone assembly 108 preferably has a first seal system 110.

Also shown in FIG. 5*a* is isolation packer 112 slip system 75 to prevent or reduce uphole movement of the packer during fracturing or other pumping operations. The slip system 75 is preferably actuated by fracturing returns, which causes individual slips 76, 78 to grippingly engage a casing or well bore (not shown). This actuation may be locked in so that the slips continue gripping engagement after the actuating pressure has been release, or, more preferably, the slips may disengage the casing once actuating pressure is relieved. An isolation packer slip system 75, such at that described in FIG. 5*a,* may prevent a safety joint or other assembly below the isolation packer (not shown) from shearing due to fracture pressure induced movement of the system. A slip system also prevents buckling of assemblies uphole from the packer, such as an adjacent zone's production screen assembly.

Figure 5B:
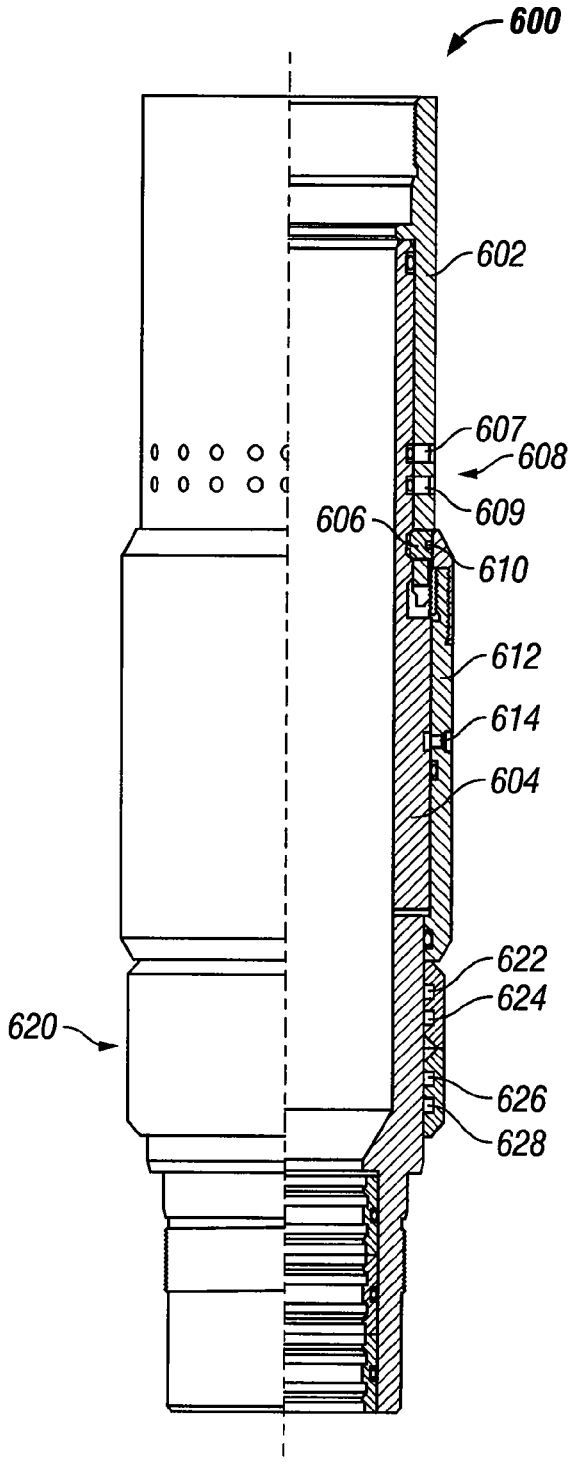
FIG. 5B illustrates a cross-sectional side view of a safety shear out system for use with the improved well completion system.

FIG. 5*b* illustrates a preferred shear out safety system that may be used with the well completion system. The shear out safety system 600 illustrated in FIG. 5*b* comprises first and second body portions 602, 604. These body portions are concentrically aligned and coupled together with a load-bearing system 606 and a shear out system 608. The load-bearing system may comprise a plurality of dogs or keys 610 between the first and second body portions 602, 604. A sleeve or piston 612 is located on the outside diameter surface of the safety system 600 and is preferably shear pinned 614 to the first and/or second body portion such that the sleeve forces the dogs 610 into load bearing arrangement, as shown in FIG. 5*b.* The shear out system 608 may comprise a plurality of shear pins between the first and second body portions 602, 604.

A preferred embodiment of the shear out safety system is designed to carry about 250,000 pounds during tripping in (as shown in FIG. 5*b*). To activate the safety system 600, such as when the completion system 100 is set adjacent the sump packer, hydraulic pressure is applied to the safety system 600 so that the sleeve 612 is moved in an axial direction (e.g., downhole) to uncover or release the dogs 610. It will be appreciated that the dogs 610 are biased to a non-load bearing orientation when not restrained by the sleeve 612. Once the dogs are release, the load bearing capability of the safety system 600 is determined by the shear out system 608. A preferred embodiment of the shear out system 608 comprises a plurality of individual shear pins 607 and 609, which are designed to carry about 100,000 pounds after the safety system 600 has been activated.

Applicants prefer that each production zone assembly 108 incorporate a shear out safety system 600. The preferred location of the safety system 600 is between the first sealing system 110 and the autolocator 106. Each product zone assembly may have a shear out safety system 600 that is designed to the same or to a different shear out load, as required or desired by the system design. Thus, FIG. 5*b* illustrates a first sealing system 110 in the form of inverted seals 190. The safety system 600 also may comprise an expandable debris barrier 620. In the embodiment shown in FIG. 5*b,* when the sleeve 612 is activated and the dogs 610 are released, the sleeve 612 compresses the debris barrier 620 and causes it to expand radially and/or circumferentially and, preferably, contact the casing. A preferred embodiment of the debris barrier 620 comprises ANSI 316 stainless steel wire that has been "bird nested" or woven to about a 50% density, as is known in the art. In the embodiment shown in FIG. 5*b,* four (4) debris rings 622, 624, 626, 628 having canted surfaces are assembled about the body to the debris barrier 620.

Figure 6A:
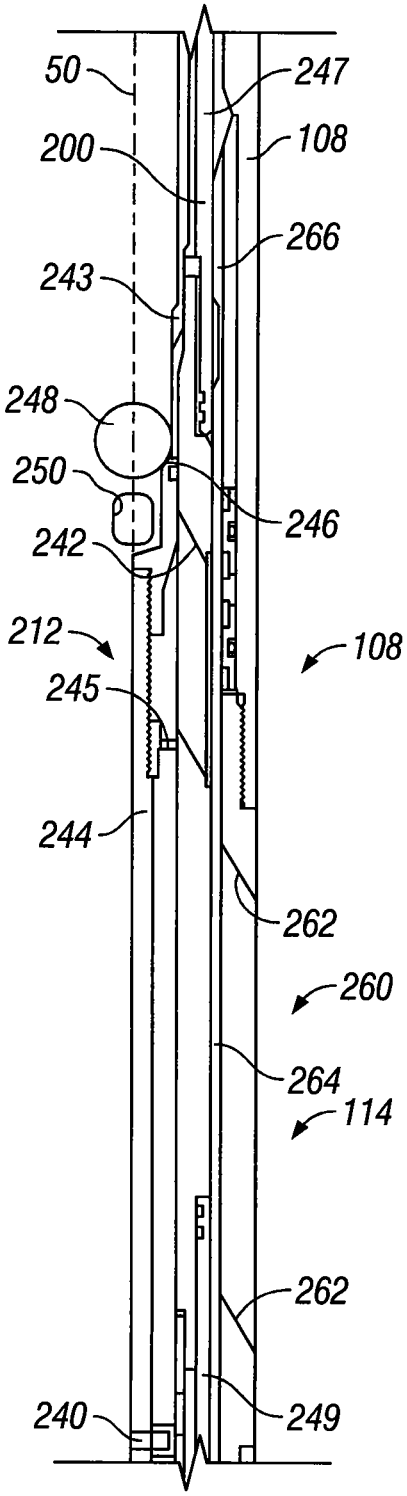
FIGS. 6A and 6B illustrate a cross-sectional side view of alternate crossover subassembly in a service tool assembly and a formation access valve in a production zone assembly for use with the improved well completion system.

FIG. 6*a* illustrates formation access valve assembly 114, or frac window, in a production zone assembly 108 and a crossover assembly 212 in a service tool assembly 200. Tool assembly 200 comprises a crossover assembly 212 having a through wall port 242 allowing fluid communication from an inside surface of the tool assembly 200 to an outside tool assembly surface. In a preferred embodiment, the through wall port is formed on an angle of between about 45 to 150 degrees, and more preferably about 120 degrees to the tool centerline, a downhole orientation. The crossover assembly 212 also comprises an internal sleeve 244 having a seat surface 246 adjacent the port 242. In a preferred embodiment, the sealing surface 246 is adapted to seal against a ball or other substantially spherical object that engages the seat 246. FIG. 6*a* illustrates a ball 248 in position on the seat 246. This ball/seat sealing arrangement may be used to activate the setting tool 208 and set the production packer 102, as is conventional. Located below the seat 246 is a circulation port 250, which allows circulation from the tool assembly 200 annulus to the inside conduit of the service tool assembly 200 during run in.

The internal sleeve 244 is slidable relative to the tool assembly 200 and is held in the position shown in FIG. 6*a* by a shear pin system 240 having combined shear strength of about 4,500 psi, which should be greater than the load generated during packer set and work string separation. The sleeve 244 is biased away from the port 242, preferably in a downhole direction, by a spring or other device (not shown).

Once pin system 240 has been sheared, the sleeve 244, including seat 246 and ball 248 are moved out of the way of the port 242. The sleeve 244 also may comprise a plurality of finger 243, which extend above the pressure-blocking device 248. The fingers 243 have a camming surface such that when the sleeve 244 moves downward to open up the crossover port 242, the fingers are cammed inwardly to trap the pressure-blocking device, such as ball 248, in position. It is desired that the ball or other device 248 not be able to migrate from its position adjacent seat 246 during subsequent well operations. It will be appreciated that the biasing element, such as a spring, retains the sleeve 244 in the retracted position after the pin system has been sheared and, therefore, the ball 248 is trapped in the sleeve. Because it may be possible for the ball to migrate from the seat, such as into cross-over port 242 while the fingers 243 are transiting the port 242, it is preferred that at least one finger be deflected inwardly at all times to trap the ball adjacent the seat. Also, it is preferred that the sleeve 244 comprises a debris ring 245, such as a molded rib seal, to prevent debris from fouling operation of the sleeve 244.

Figure 6B:
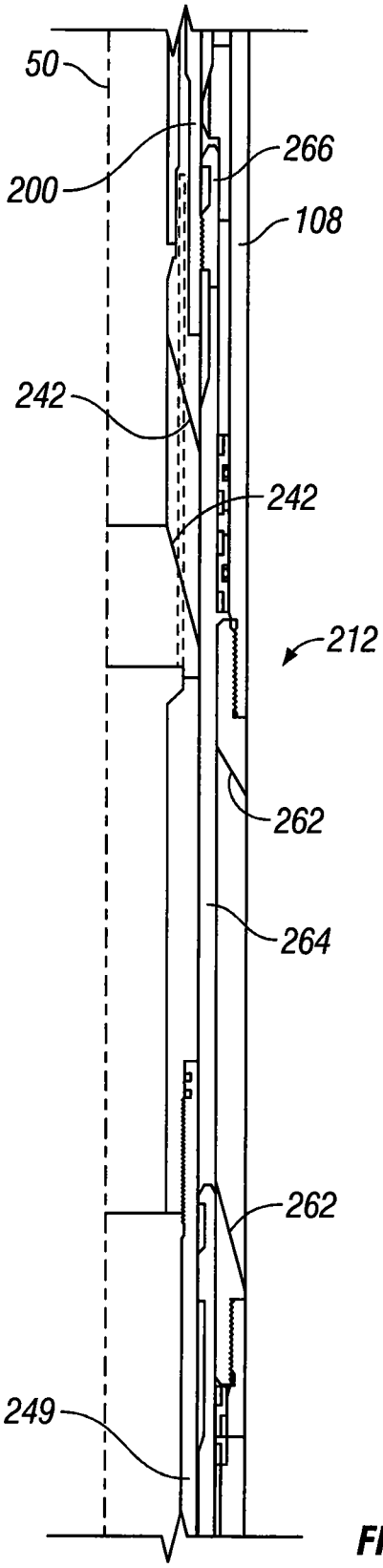

Alternately, and preferably, as shown in FIG. 6*b* the crossover assembly 212 does not comprise a sleeve 244 and the port 242 is always uncovered on its inside surface. Thus, there is no seat 246 and no need to pressure up against a pressure-blocking device 248. As mentioned above, a lightweight ball may be dropped into to the system and seat upon a structure relatively near the production packer 102. Pressurization against this ball can be used to set the production packer 102, and then the lightweight ball may be reversed out of the system.

Figure 7A:
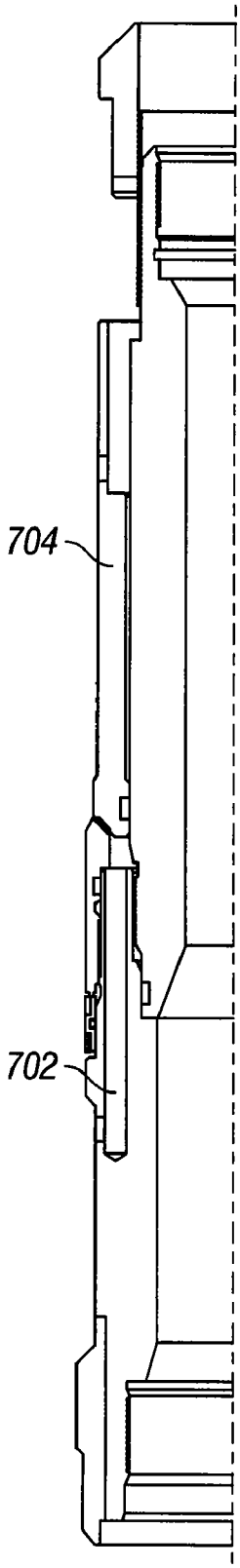
FIG. 7 illustrates a cross-sectional side view of a hydraulic setting tool for use with the improved completion system.
Figure 7B:
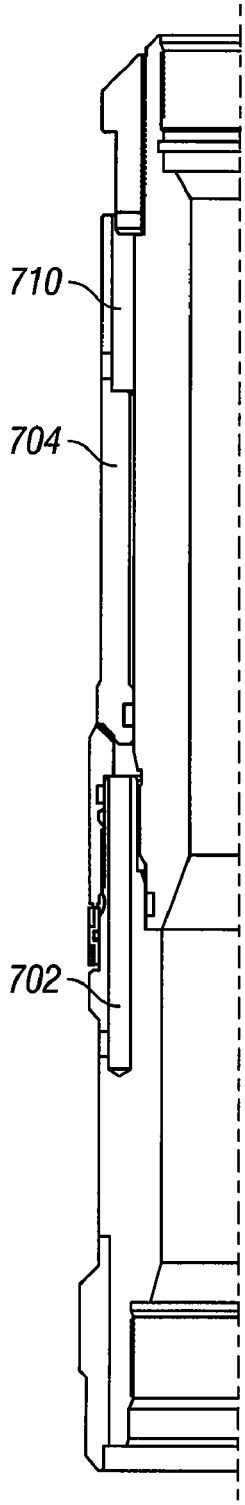
Figure 7C:
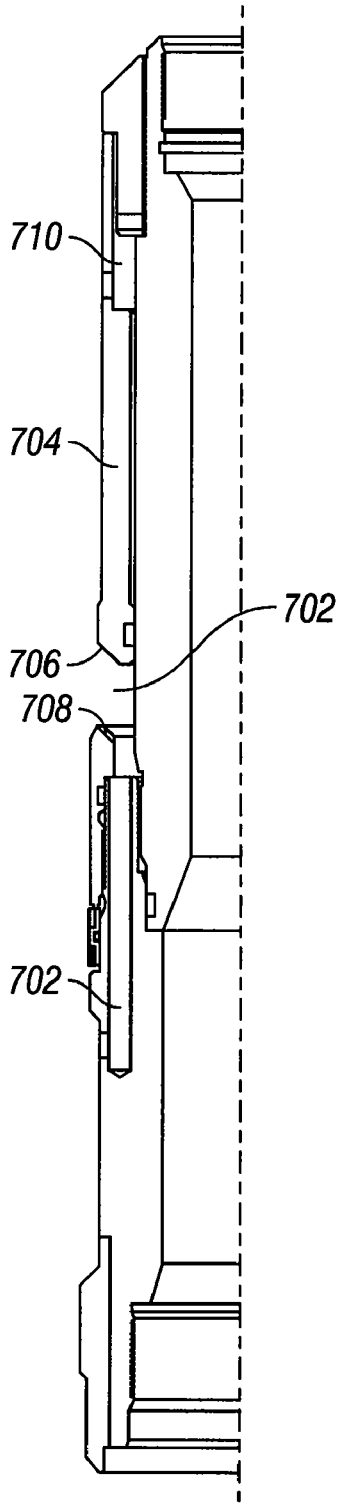

Still further, FIG. 7 illustrates a hydraulic setting tool for setting the production packer 102 with a cross over assembly like that illustrated in FIG. 6*b*. The hydraulic setting tool 700 comprises a one-way flow conduit 702. The flow conduit 702 comprises a sleeve 704 biased into a no flow condition (e.g., uphole flow) as shown in FIGS. 7*a* & *b*. A sealing surface 706 on the sleeve 704 interacts with a seal 708 to seal substantially the flow path 702. When the sleeve 704 is pressurized from the flow direction (e.g., downhole flow), the biasing force 710 is overcome and the sleeve moves axially uncovering or opening the flow path 702. When the pressure is reduced to below the biasing force, the one-way valve closes. It will be appreciated that this feature of the hydraulic setting tool facilitates a wash down operation.

Returning to FIGS. 6*a* and 6*b*, in a preferred embodiment, a portion of the crossover assembly 212 comprises hardened seal surfaces, such as, but not limited to, nitrided slick joints 247, 249 above and below the crossover port 242. These slick joints 247, 249 interface with the first and second sealing systems 110, 116 to for a high-pressure seal for pumping and other well operations. At the distal end of the upper slick joint 247, a primary backup autolocator shoulder (not shown) may be formed for actuation of the autolocator 106 should the autolocator profile 210 be out of position.

A formation access valve assembly 260, or frac window, is also illustrated for the production zone assembly 108. The formation access valve assembly 260 comprises a through-wall flow port 262 and a sliding, sealing sleeve 264. The sliding sleeve has a closing profile 266 located adjacent a proximal end and an opening profile (not shown) located adjacent a distal end. Suitable seals are provided so that the port 262 is sealed against fluid flow when the body of the sleeve 264 blocks the port 262. The port 262 is preferably elongated relative to the crossover port 242 so that if autolocator profile 210 on service tool 200 is not engaged in the insert 178 (i.e., groove 176) but rather on top of the insert 178, fluid communication is still achieved between the crossover port 242 and the frac port 262.

FIGS. 6*a* and 6*b* illustrate the well completion system in the "Run-In" condition in that tool port 242 is not aligned with the packing port 262 and the sliding sleeve 264 has sealed off the packing port 262. In a "Frac/Set-down" condition, it will be appreciated the ports 242 and 262 are in substantial alignment and the sliding sleeve 264 no longer seals the port 262.

Figure 8:
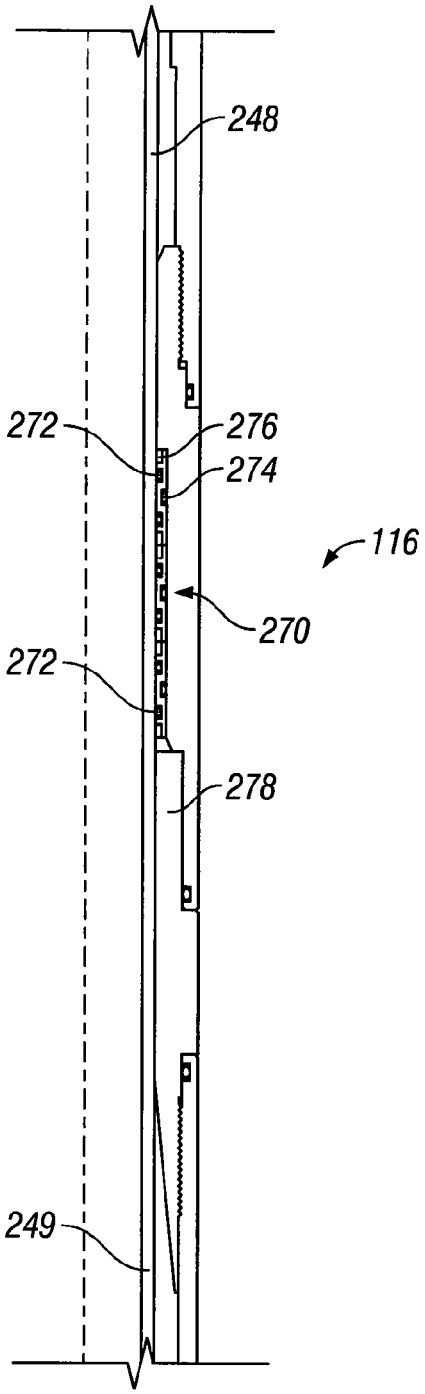
FIG. 8 illustrates a cross-sectional side view of a second inverted seal system for use with the improved completion system.

FIG. 8 illustrates a second seal system 270 on the production zone assembly 108 located distal of the formation access valve assembly 260. In a preferred embodiment, the second seal system 270 is substantially the same as the first seal system 190. The seals 270 are preferably molded elastomeric seals 272 on a metal carrier 274, although other sealing technologies, such as, but not limited to, PTFE, PEEK and/or PEKK may be used. The seal system 270 may be described as "inverted" in that the sealing surfaces 272 are exposed to the inside of the production zone assembly 108. As shown in FIG. 8., a stack of 3 seal rings is held in a seal recess 276 by a retainer 278. The seal system 270 is adapted to sealingly engage a portion of the tool assembly 200, such as, but not limited to, a slick joint. It will be appreciated that each production zone assembly 108 preferably has a second seal system 270.

Figure 9:
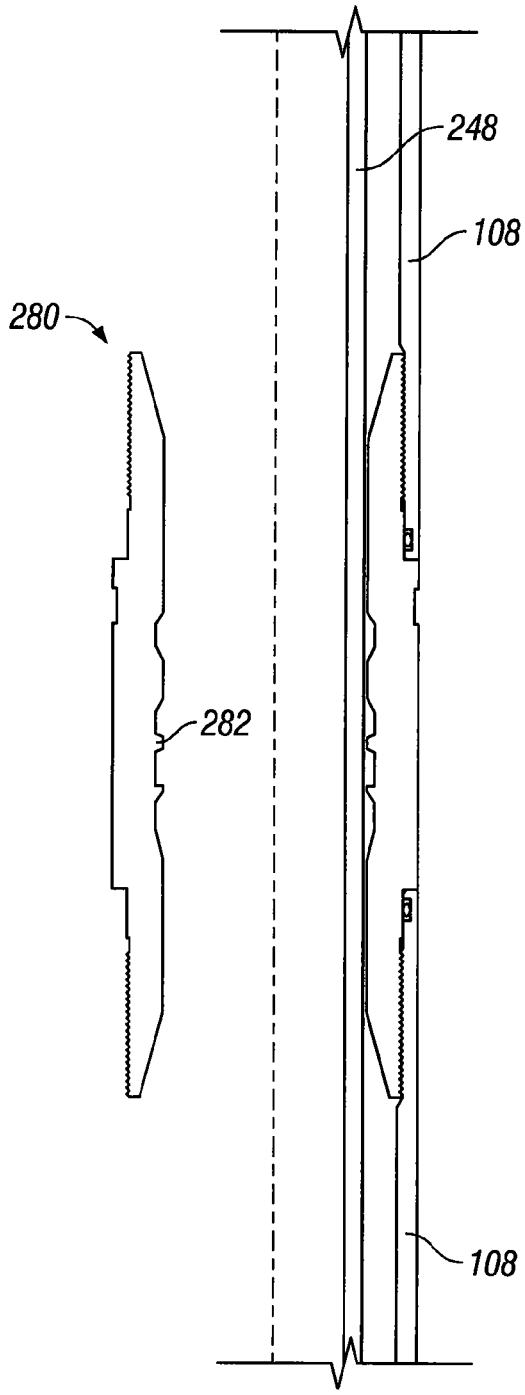
FIG. 9 illustrates a cross-sectional side view of a circulating valve shifting profile associated with a production zone assembly for use with the improved well completion system.

FIG. 9 illustrates a circulating tool shifting profile 280 that may be incorporated into a production zone assembly 108 according to the present invention. The indicating profile 280 has a closing profile 282 that closes a circulation valve 216 in the service tool assembly 200 when the completion system is changed from the "Frac/Set-down" position to the reversing condition.

Figure 10A:
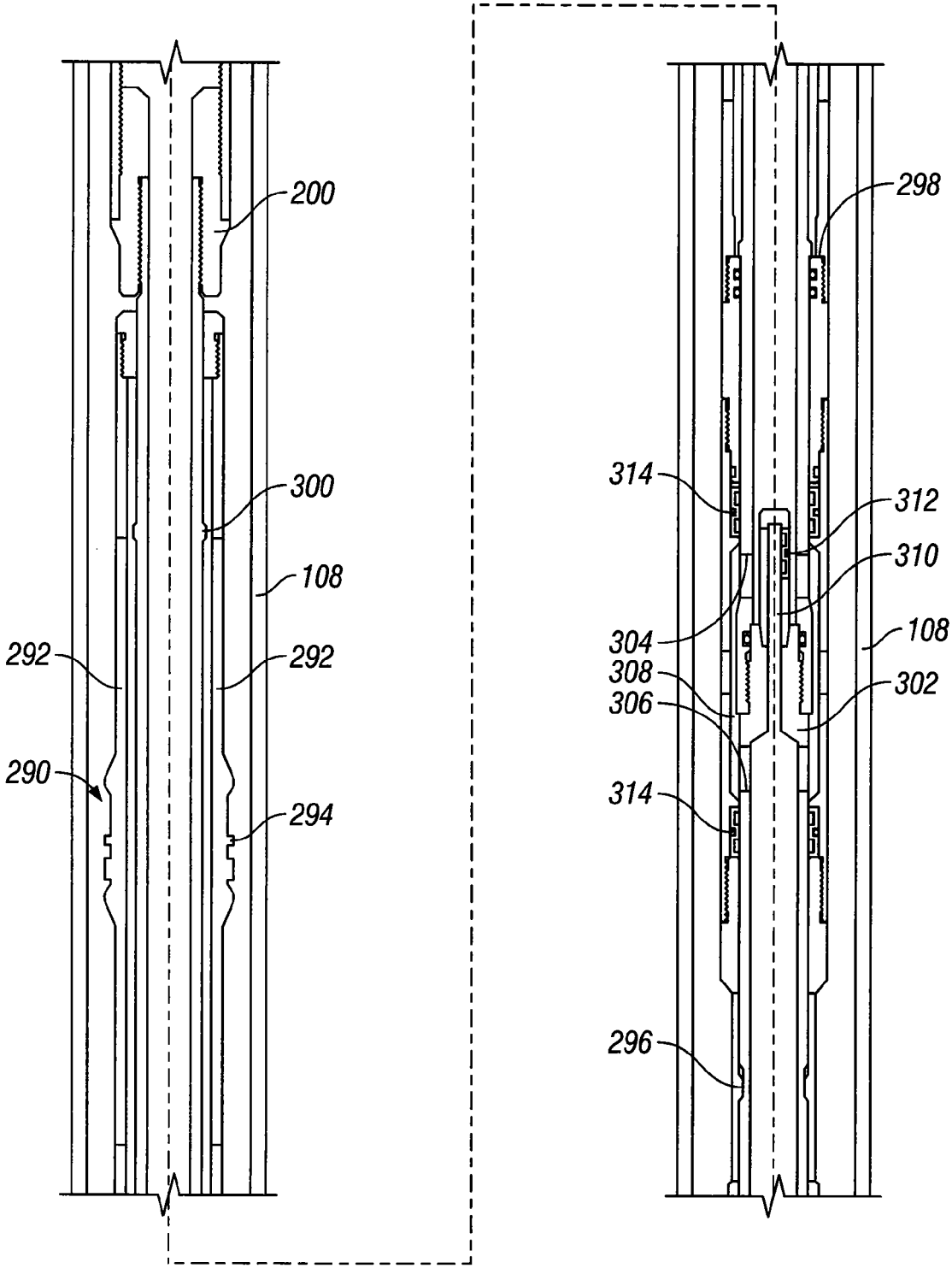
FIG. 10A illustrates a cross-sectional side view of a closing tool assembly having a circulation valve, associated with a service tool assembly for use with the improved well completion system.

FIG. 10*a* illustrates a portion of the service tool assembly 200 comprising a closing tool 290. Closing tool 290 comprises a plurality of collet fingers 292, preferably 6 to 8, spaced about an outer portion of the tool assembly 200. The collet fingers 292 have a closing profile 294 located approximately mid-length, which is adapted to engage a corresponding structure on production screen valves, such as, but not limited to, for example, on sleeves covering ports, to close such valves when desired. The closing tool 290 further comprises a detent 296 that, in the preferred embodiment requires about a 2 kip load to displace the detent in a downhole direction and about 600 $lb_f$ load to displace the detent in an uphole direction Also shown in FIG. 10*a* is a going-down shoulder 298 and a pick up shoulder 300.

Figure 10B:
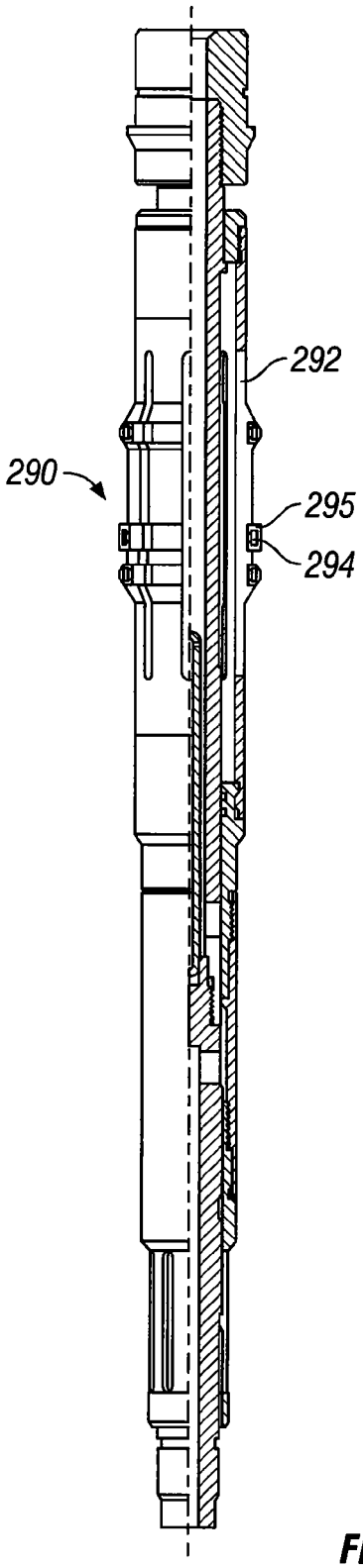
FIG. 10B illustrates a cross-sectional side view of an alternate closing tool assembly associated with a service tool assembly for use with the improved well completion system.

FIG. 10*b* illustrates an alternate embodiment of the closing tool 290. The embodiment shown in FIG. 10*b* comprises profile inserts 295 preferably fabricated from a material having superior anti-galling properties, such as, but not limited to the beryllium copper alloy discussed previously. The insert 295 may be physically fastened to the collet finger 292, such as by threaded fasteners. Additionally, and preferably, the entire collet finger/closing profile assembly may be fabricated from the anti-galling material. The opening tool profiles disclosed below will also benefit from the anti-galling inserts and/or fabrication of the entire collet finger/opening profile assembly from an anti-galling material.

FIG. 10*a* also illustrates a circulating valve 302 having flow ports 304 and 306. In the "Run-In" position shown in FIG. 10*a*, the circulation valve 302 allows fluid communication from below the valve, through ports 306, in to an annular space 308, through ports 304 and back into the interior of the tool assembly 200. Seals 314 may seal annular space 308 to the tool assembly 200. Circulation valve 302 also includes a bleed path 310 and bleed ports 312 to prevent a hydraulic lock from forming when the tool string is moved up to close a valve. It will be appreciated that debris may accumulate in the annular area outside of bleed path 310 and ports 312. Tool designers will appreciate the benefit of placing the ports 312 high enough out of the way not to become blocked by such debris. Movement of the closing tool 292 in a downward direction relative to the circulation valve 302 (i.e., moving the tool string uphole) closes off ports 304 restricting flow though the valve 302. In a preferred embodiment, the closing tool profile is selective in that it does engage or interact with the autolocator 106.

Figure 11A:
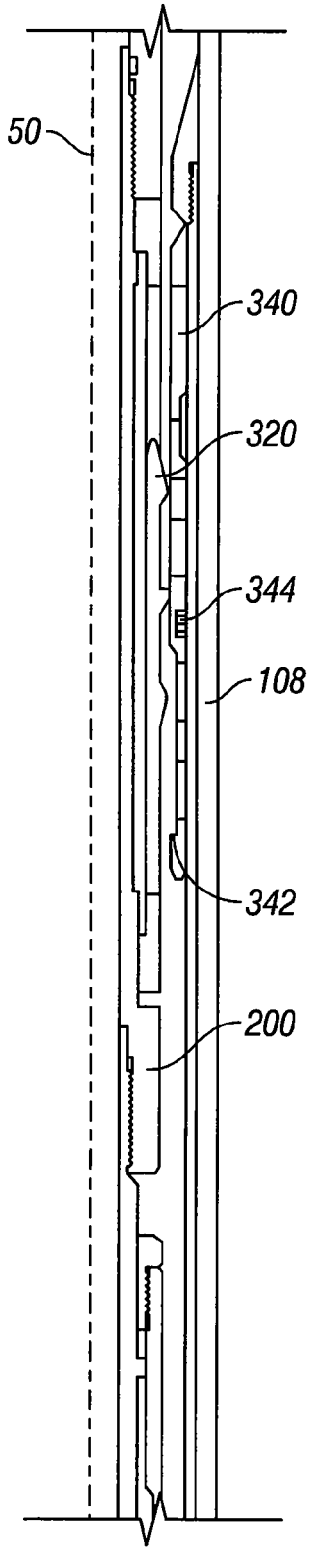
FIGS. 11A and 11B illustrate cross-sectional side views of alternate secondary indexing collet associated with a service tool assembly for use with the improved well completion system.

FIG. 11*a* illustrates secondary backup autolocator collet assembly 320. Similarly to the primary backup autolocator shoulder, describe with reference to FIGS. 6*a* and 6*b,* the secondary backup autolocator collet 320 may be provided as a convenience measure for the improved completion system. For example, if the tool assembly 200 is pulled above the autolocator 106 while in the "Frac/Set-down" condition, either the primary backup autolocator shoulder or the secondary backup autolocator collet 320 allows the operator to cycle the indexing system 154 back to the "Run-In" condition. Also, after a well treatment, such as, but not limited to, a fracturing or gravel packing treatment, the completion tool assembly 200, and specifically closing tool 292, may be pulled up through the autolocator 106 and to engage the autolocator lock out sleeve 180, and specifically profile 181. As described above, the lock out sleeve 180 moves the autolocator bearing 178 out of the way and into recess 182. If the closing tool 292 failed to engage and activate the lock out sleeve 180, the secondary backup 320 will indicate this occurrence by registering a snap through load of about five kips as the collet 320 encounters the bearing 178.

Figure 11B:
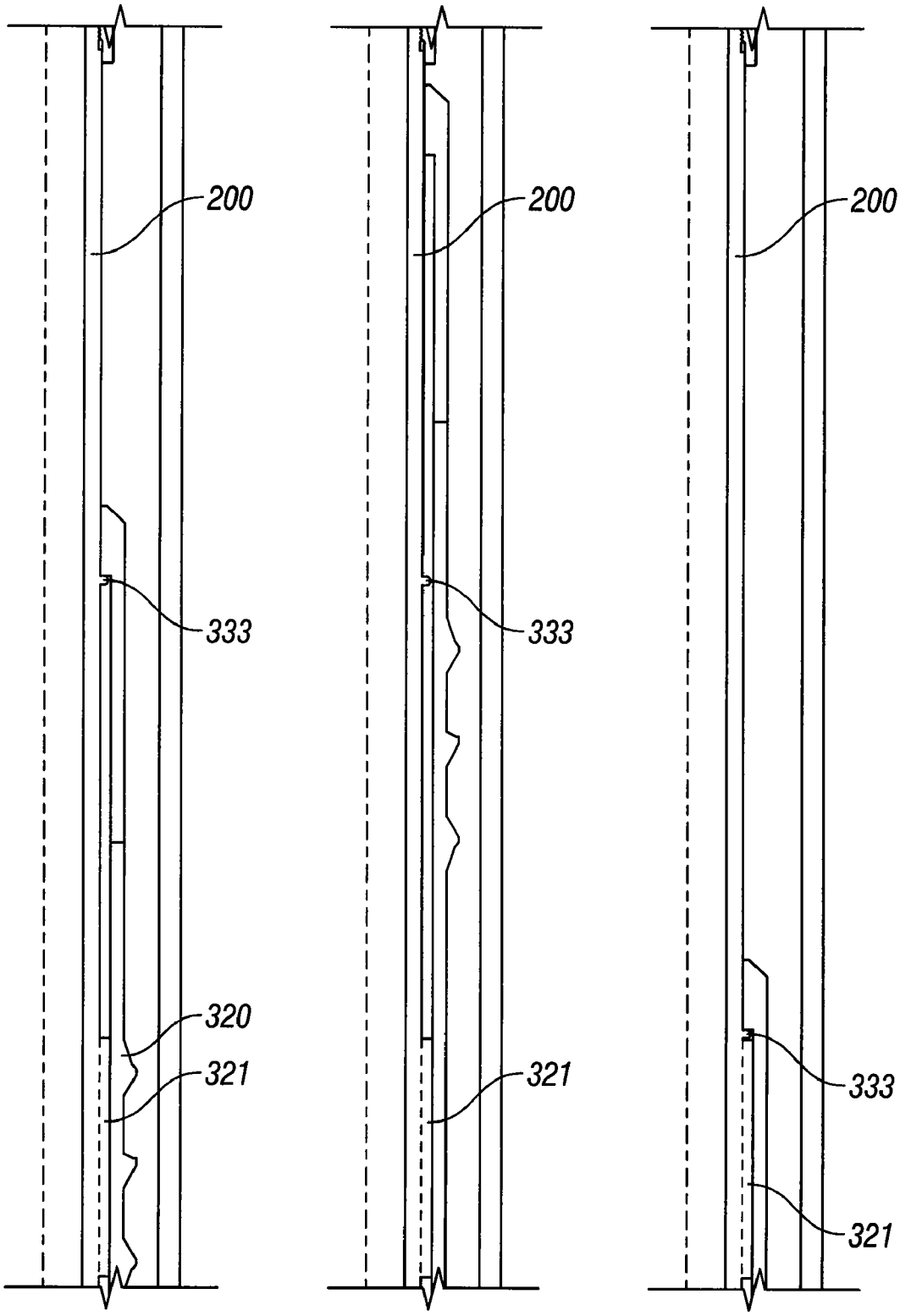

FIG. 11*b* illustrates a preferred embodiment of a secondary backup autolocator collet assembly 320. The leftmost drawing shows the assembly 320 in the "Pick-Up" position; the middle drawing shows the assembly 320 in the "Run-In" condition; and the rightmost drawing shows the assembly 320 in the sheared condition. In the "Run-in" condition, the collet is not supported by back-up 321 and is able to deflect out of the way. When the system in the "Pick-Up" condition, the collet 320 is backed-up and is not able to deflect out of the way. The backed-up collet 320 will carry a load dictated by the shear strength of shoulder 333. Shoulder 333 may be set of shear screws, a shear ring or a similar system. In the preferred embodiment, the backed-up collet assembly 320 can carry about 60 ksi. This load carrying capacity is beneficial if debris has fouled the autolocator system 106 and more load is needed to cycle the system. If the autolocator system 106 cannot be cycled by the collet assembly 320 with 60 ksi, the shoulder 333 will shear loose and the collet 320 will once again not be backed up and free deflect at its designed load.

Also shown in FIG. 11*a* is a mock sliding sleeve 340. The mock sleeve 340 has a opening profile 342 and is initially pinned to the lowermost production assembly 108 by shear pins 344 having a combined shear strength of about 3.9 kips. Once the opening tool 330 has been activated (as described below), the mock sleeve 340 may be used to verify that the opening tool 330 has indeed been activated.

Figure 11C:
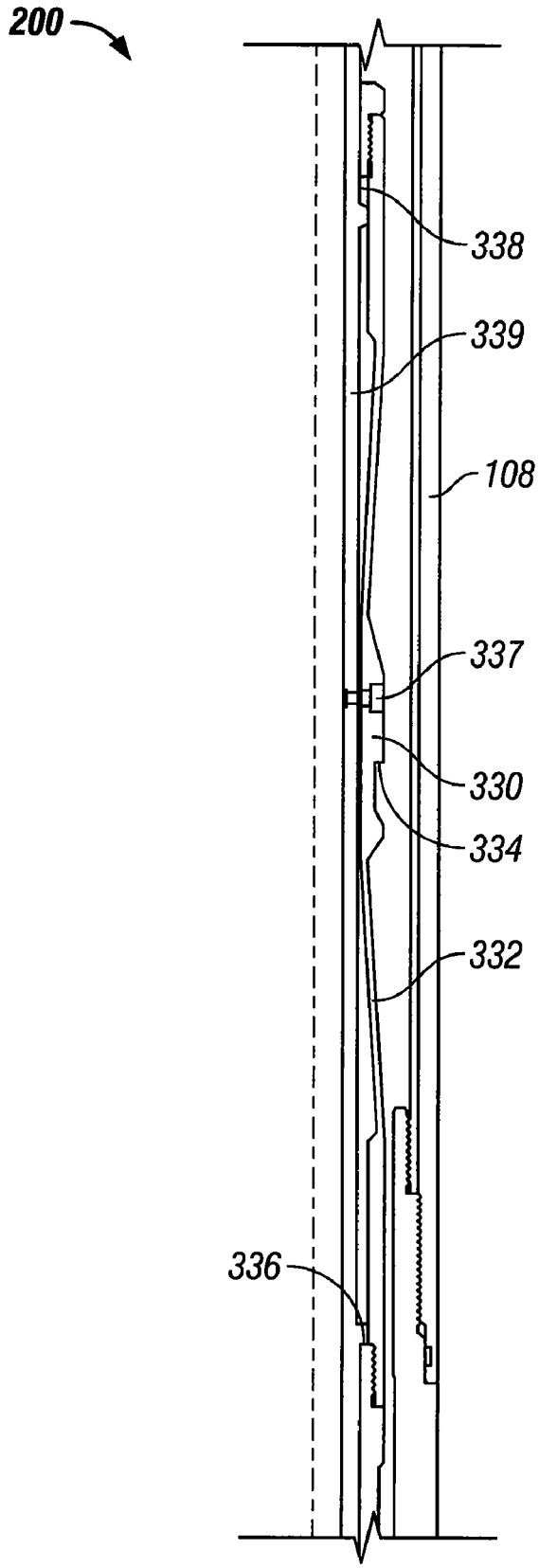
FIG. 11C illustrates cross-sectional side view of a deactivated opening tool associated with a service tool assembly for use with the improved well completion system.

Shown in FIG. 11*c* is opening tool assembly 330 disposed on completion tool assembly 200. Similar to closing tool 292, opening tool 330 comprises a plurality of collet fingers 332, preferably 6 to 8, spaced about an outer portion of the tool assembly 200. The collet fingers 332 have an opening profile 334, and preferably a selective profile, located approximately mid-length and adapted to engage a corresponding structure on production screen valves, such as, but not limited to, for example, on sleeves covering ports, to open such valves when desired. The opening tool 330 is illustrated in the "Run-In" condition in FIG. 11*c* and is deactivated. More specifically, the opening tool 330 is coupled to nosepiece 378 and is slidable between stops 338 and 336 relative to tool portion 339. The opening profile 334 is pinned inwardly to tool portion 339. In this deactivated condition, the opening tool 330 will not engage a corresponding profile to open a valve. In a preferred embodiment, the opening tool 330 is pinned to the tool assembly 200 by shear pins 337 having combined shear strength of about 4.6 kips. In the Run-In condition, load is borne by the shoulder 336 and not the shear pins 337.

As will be recalled from the general discussion of the improved completion system, if it is desired to run in on a work string, it is preferred to run the completion tool assembly 200 into the lowermost production assembly 108 while hanging off the rig floor. However, regardless of when the tool assembly 200 is run in, if the opening tool 330 is not deactivated during run in, the normally closed production screen valves may be opened as the tool 200 is lowered. After each valve is opened, the operator must reverse direction to use the closing tool 292 to re-close the opened valve. Thus, deactivating the opening tool 330 in this manner saves time, which in turn saves money. The opening tool 330 may be activated when the completion tool assembly 200 engages the opening tool activation assembly 122, or preferably, hydraulically, as discussed below.

Figure 12:
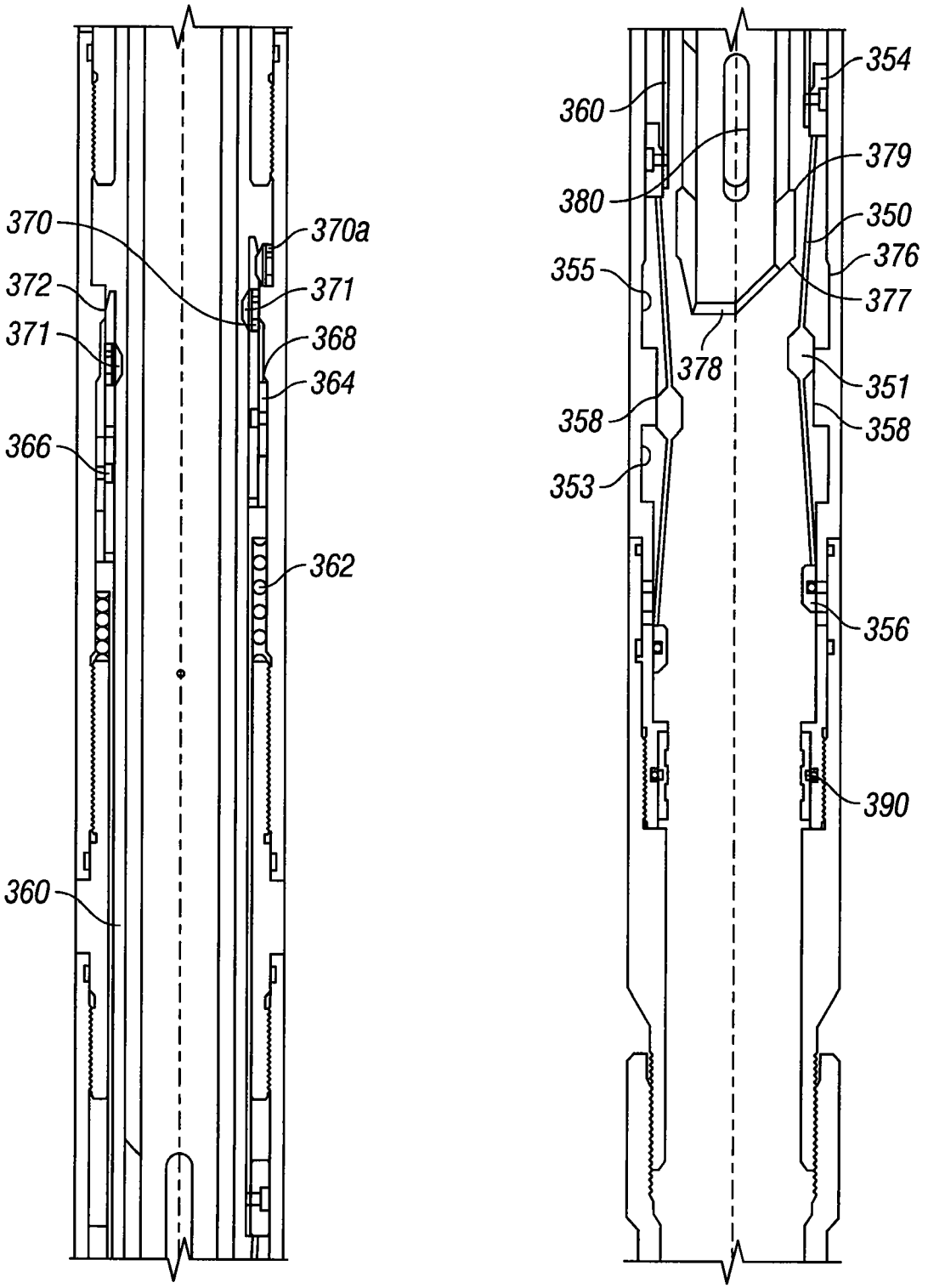
FIG. 12 illustrates a cross-sectional side view of an opening tool activation assembly associated with a lowermost production zone assembly for use with the improved well completion system.

FIG. 12 illustrates a portion of a bottom assembly 104 comprising an opening tool activation assembly 122 for use with the improved completion system. The activation assembly may comprise stop collet assembly 350 having a plurality of fingers 352 extending between proximal 354 and distal 356 base rings. The proximal base ring may be and preferably is shear pinned to a sleeve 360 in the bottom assembly 108 by shear pins having a high strength, such as, but not limited to, for example, about 24 kips. The distal base ring may likewise be shear pinned to the production assembly 108 but preferably at much lower shear strength. For example, in preferred embodiment, the distal base ring is pinned at a shear strength of about 2.6 kips. In the "Run-In" condition, shown on the right half of the sectional drawings, the stop collet 350 is biased inwardly by land 358. The sleeve 360, to which the stop collet 350 is coupled, is biased by spring 363 in an upward direction. Sleeve 360 is shear pinned to a ring 364 by a plurality of shear pins 366. Ring 364 limits the amount of upward travel of sleeve 360 through reaction with shoulder 368. Located on a proximal end of the sleeve 360 is an expanding ring 370 having a plurality of lugs 371. During "Run-In" the expandable ring 370 is cammed inwardly into the interior of production assembly 108 by camming surface 372.

To locate the service tool assembly properly in the completion assembly and to activate the opening tool 200, the service tool assembly 220 is lowered into the completion assembly so that the nosepiece 378 contacts the lugs 371 and drives the lugs downward into the recess formed by shoulder 368 allowing the nosepiece to pass by. The service tool assembly 200 continues downhole until nosepiece 378 and specifically portions 377, contact stop collet lugs 351. Further downward movement of the nosepiece 378 against the stop lugs 351 shears the distal base ring 356 free as the sleeve 360 moves downhole relative to the production assembly 108 and compresses spring 362 as shown in the leftmost cross-section of FIG. 12. Once the stop collet 350 has been sheared free at the distal ring 356, the lugs 351 are displaced into recess 353 and the nose is allowed to pass by the stop lugs 351. Once the nosepiece 378 by passes the stop lugs 351, the spring 362 causes the sleeve 360 to move upwardly thereby camming the expandable ring 370 inwardly again and retrieving the stop lugs from recess 353.

The service tool assembly is retracted and nosepiece portions 379 contact the underside portion of the stop lugs 351. Further uphole movement causes the opening tool assembly to slide relative to the tool assembly and the opening tool is deactivated by shearing pins 337 at about 4.6 kips. Further uphole movement of the service tool assembly causes the stop lugs to displace into recess 355 and allow the nosepiece to pass by. The nosepiece then contacts the underside of ring lugs 371. Further uphole movement causes the ring to shear free at bout 8 kips. Once the sleeve 360 is sheared free from the ring, the spring 362 maintains the ring lugs 317 and the stop lugs 351 in their respective recesses.

Also shown in FIG. 12 is an additional seal system 390 comprising inverted molded seals as described above. These seals may be useful if the pressure test assembly fails to hold pressure. In that event, the lowermost slick joint on the service tool assembly 200 may be lowered to engage this seal system to pressure test the well completion system. Also, as described below, these seals could be used to hydraulically activate an opening tool.

Figure 13:
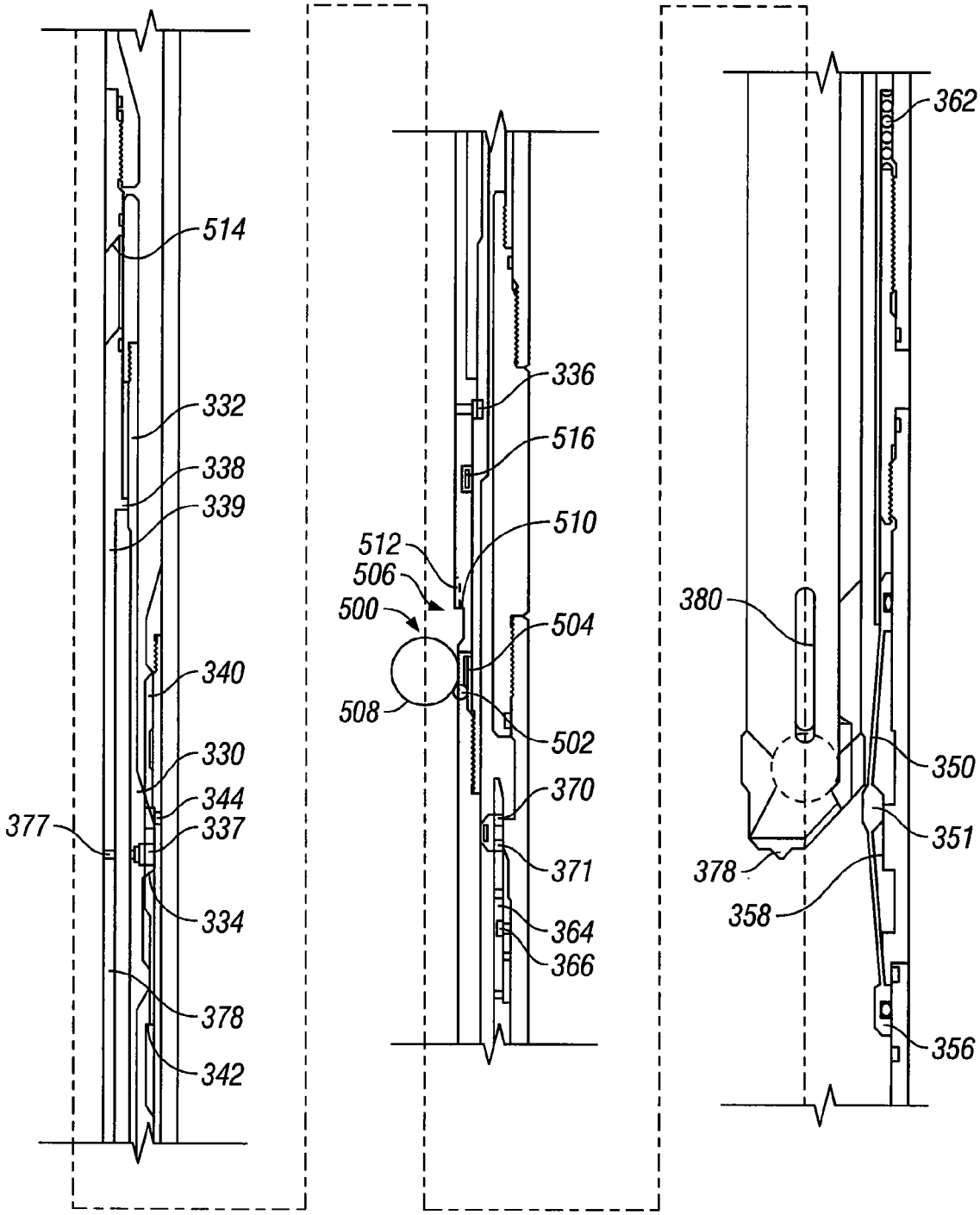
FIG. 13 illustrates a cross-sectional side view of a hydraulic opening tool activation assembly associated with a lowermost production zone assembly for use with the improved well completion system.

FIG. 13 illustrates a preferred embodiment of an opening tool assembly 330 utilizing hydraulic activation rather than the mechanical activation described above. Reference numbers are used for similar structures described above. FIG. 13 shows the opening tool 330 after hydraulic activation. It will be understood that in the "Run-In" condition, the opening tool 330 is pinned inwardly to the tool body 339 by shear pins 337, as described above. To activate the assembly 300, a slick joint on the service tool is located in a set of inverted seals to facilitate pressurization of the assembly 300. In this particular embodiment, the tool body comprises a seat system 500 comprising a plurality of balls, such as six (6) ⅜" diameter stainless steel ball bearings 502. The ball may be held in the tool body 339 such that a portion of the balls 502 extend into the tool body 339 passage to form a load-bearing seat. Adjacent the seat is a seal system 540, such as an elastomeric molded seal system. A predetermined distance above the seal system 504 is a bypass/blocking shoulder system 506. A pressure-blocking device 508, such as a stainless steel ball may be placed in the work string during assembly such that it is captured between the seat formed by balls 502 and the blocking shoulder 510. It will be appreciated that downhole flow will cause the pressure device 508 to react against balls 502 and to seal against seal system 504. Uphole flow will cause the pressure device 508 to lift off the seat and react against blocking shoulder 510. However, bypass conduits allow uphole fluid communication.

Those of skill in the art will appreciate that the hydraulic pressure used to activate the opening tool 330 by reaction against the pressure device 508 should be less than the pressure needed to set the isolation packers in the production zone assemblies and less than the pressure to activate a shear safety system, if used. Pressuring against the pressure device 508 causes relative movement between the opening collet 330 and the tool body 399 such that the shear pins 337 are defeated and the opening tool is activated. In the particular embodiment of FIG. 13, the opening tool 330 moves relatively downhole and uncovers debris port 514 and is locked into position relative to the tool body 339 by locking element 516. Hydraulic activation also uncovers bypass windows 514, which help to keep sand debris away from opening collet 330.

Figure 14:
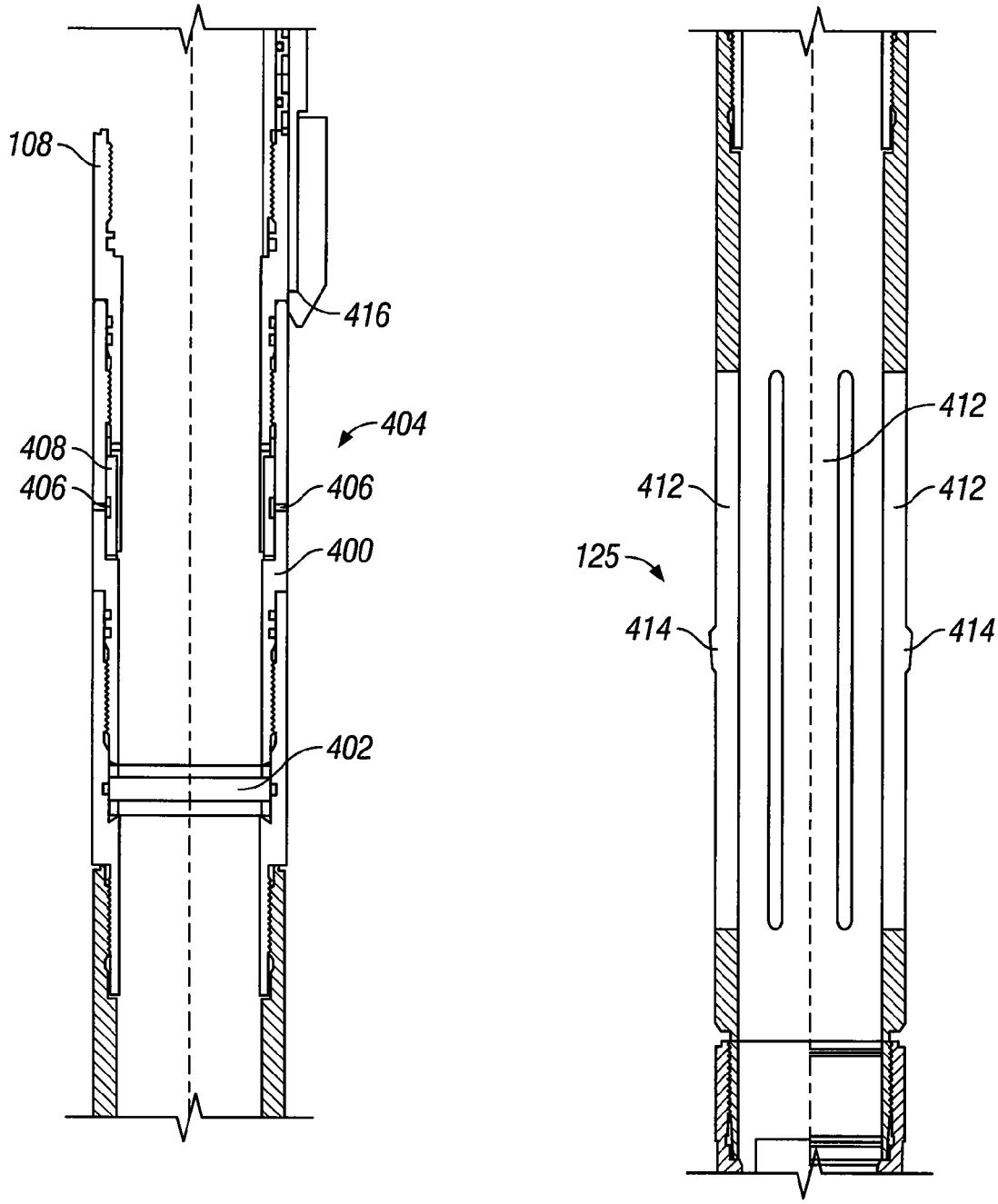
FIG. 14 illustrates a pressure test assembly and indicating collet assembly associated with a lowermost production zone assembly for use with the improved well completion system.

FIG. 14 illustrates a pressure test assembly 400 suitable for use with the improved well completion system. The test sub 400 comprises a pressure-blocking device 402 across the interior of the completion assembly 100. The pressure blocking device 402 illustrated in FIG. 12 may comprise a glass disk having a bursting strength of about 2000 psi, or about four times the pressure used to test the pressure integrity testing of the completion system prior to running into the well. The pressure test sub 400 also comprises a check valve 404. A preferred embodiment of the check valve comprises ports 406 to allow fluid to communicate from the annulus exterior to the production assembly 108 into the interior of the test sub 400. However, a rubber bladder 408 prevents fluid in the test sub 400 from communicating out through the ports 406. The check valve allows well fluids to enter the production assemblies as they are being hung off the rig floor during make up.

FIG. 14 also illustrates an indicating collet assembly 125, which may be attached to the distal end of test assembly 400. The indicating collet 125 may comprise a plurality of fingers 412, such as, but not limited to, four, and each finger may have an indicating profile 414 thereon. The indicating profiles 414 are adapted to snap through reentry guide 416 on the bottom of the sump packer. The reentry guide 416 and indicating profiles 414 are adapted to provide a snap through up load of about 10 kips to positively indicate that the production assembly is correctly positioned in the well bore.

Figure 15:
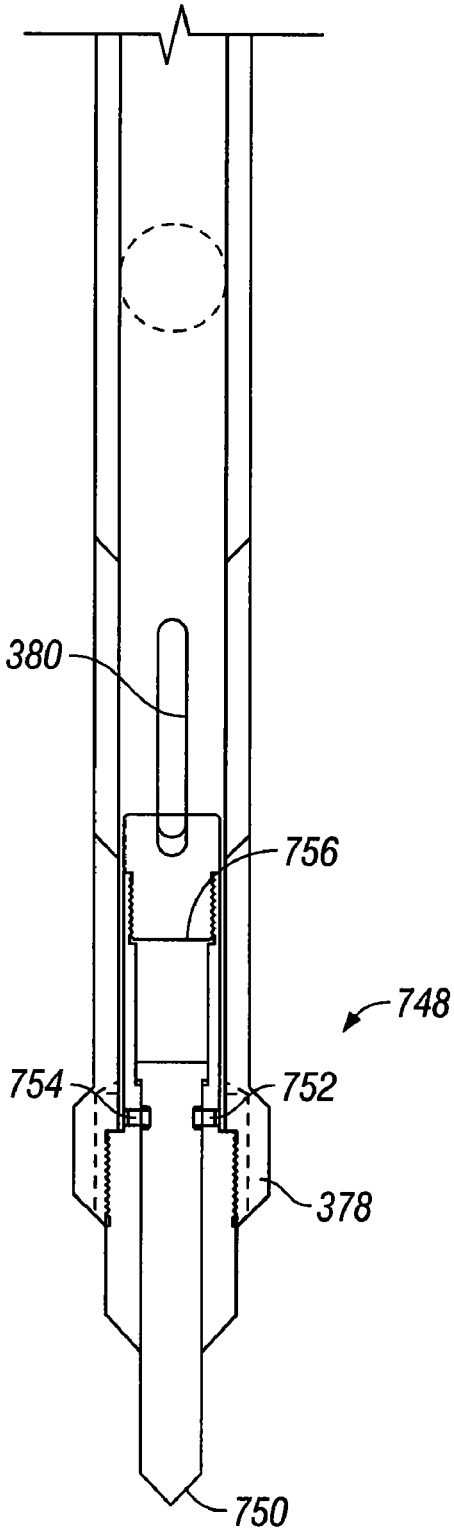
FIG. 15 illustrates an alternate nose piece associated with a service tool assembly for use with the improved well completion system.

FIG. 15 illustrates a preferred nose piece 378 for the service tool assembly 200 (See FIG. 13). In the embodiment shown in FIG. 15, the nose piece comprises a dynamic loading system 748 for facilitating rupturing the pressure blocking device 402 (FIG. 14). The dynamic loading system may comprise a pin 750 having a hardened, such as carburized, pointed surface for contacting the pressure-blocking device 402. The pin 750 is housed within a body that permits the pin to move axially, or stroke, a predetermined amount, such as, for example, 2 inches. Initially, the pin 750 is shear pinned to the body. In a preferred embodiment, the pin 750 is sheared pinned 752, 754 to a load of about 4,000 to 5,000 pounds. It will be appreciated that when it is desired to rupture the pressure-blocking device 402, load is applied to the service tool assembly and the pin 750 contact the device 402. If the device 402 does not rupture immediately, the load will exceed the shear strength of the shear pins 752, 754 and the pin 750 will dynamically stroke into the body causing an impact load to be imparted to the device 402. If the device 402 still has not ruptured, the pin 750 is now back-up in the body and the hardened point may be used to apply additional load to the pressure-blocking device 402.

Referring back to the general discussion of the use and operation of the improved well completion system, once the well completion system has been made up and pressure tested, and the pressure test assembly open, such as by shattering the glass disk with nosepiece 378, the well completion system may be place in the well bore and each zone sequentially or randomly completed in one downhole trip.

Figure 16:
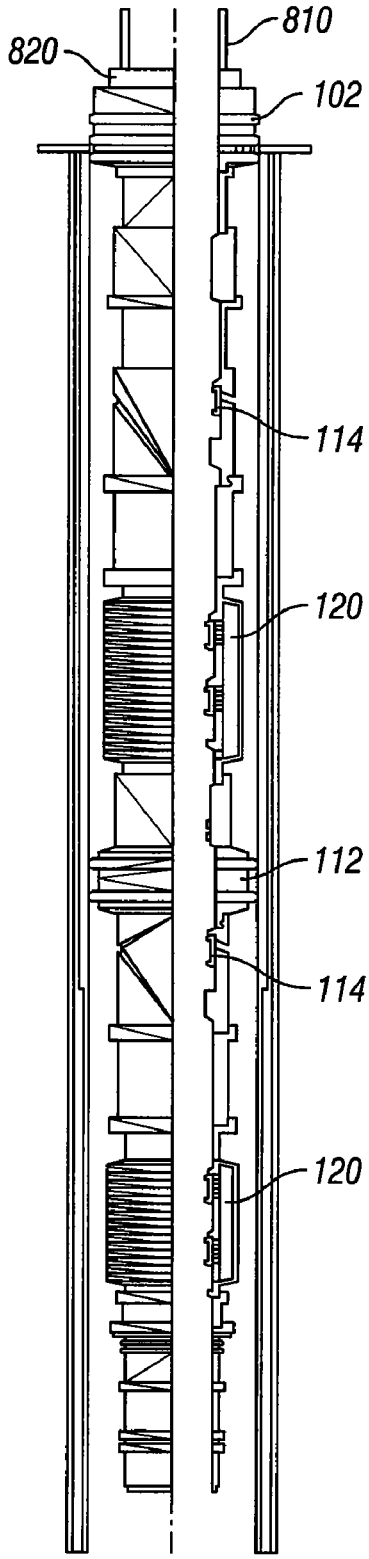
FIG. 16 illustrates an embodiment of the present invention in which the production assembly is run in the well on production tubing.

As noted previously, some embodiments of the present invention may comprise running in the completion assembly 100 on the actual production tubing. It will be appreciated that these embodiments are beneficial for control line applications insofar as the complex and sometimes problematic control interface at the production packer can be eliminated. In addition, running in on production tubing allows full wellbore isolation during substantially all phases of completion activity. FIG. 16 illustrates an embodiment of completion assembly 100 that may be run in on production tubing 810 as the assembly is hung off the rig floor 800. The production tubing and any associated control lines (not shown) are coupled, preferably removably, to the production packer 102 by a production tubing seal assembly 820.

Figure 17:
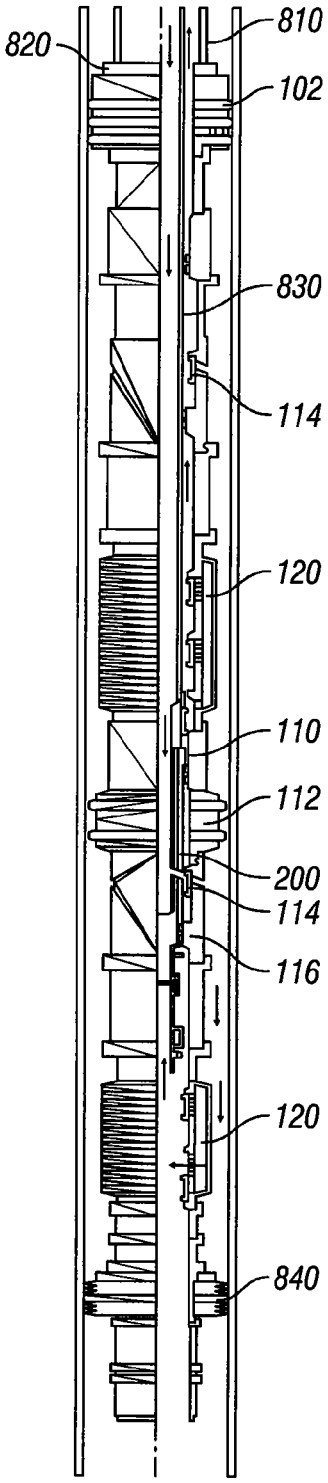
FIG. 17 illustrates the embodiment of FIG. 16 while treating a lower production zone.
Figure 18:
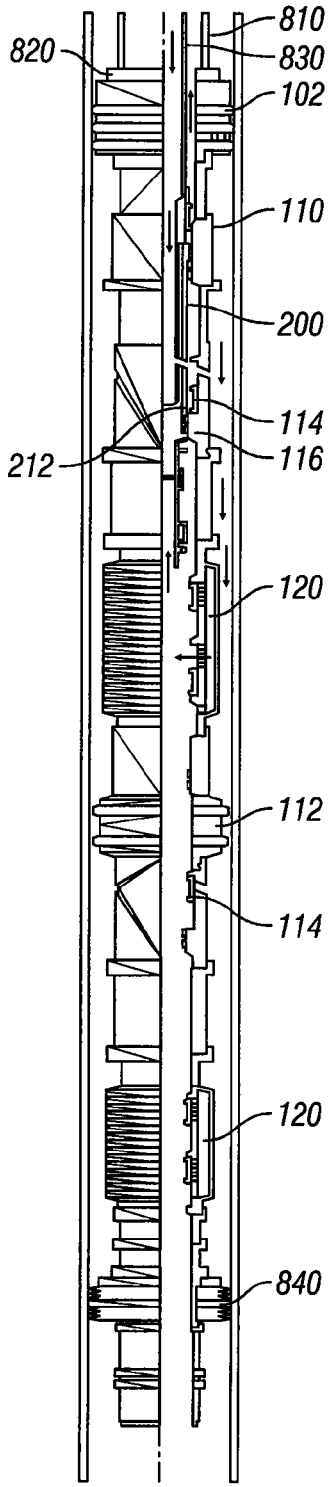
FIG. 18 illustrates the embodiment of FIG. 16 while treating an upper production zone.
Figure 19:
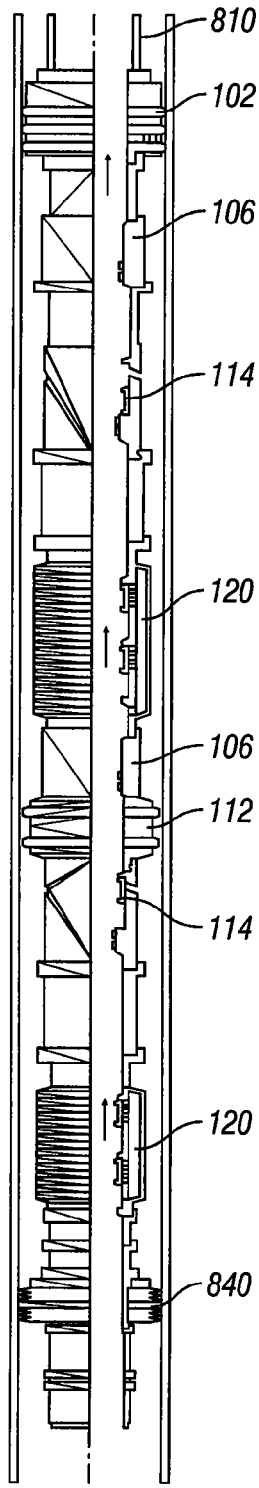
FIG. 19 illustrates the embodiment of FIG. 16 during selective production from a lower zone.

FIG. 17 illustrates the completion assembly 100 of FIG. 16 after it has been run into the well on production tubing 810 and positioned relative to the sump packer 840. The production packer 102 has been set by, for example, control line activation. The service tool assembly 200 is illustrated run into position on workstring 830 to treat the well, such by Frac packing the lower most zone. The formation access valve assembly 114 is shown in the opened condition and the ports are aligned with the service tool 200 ports. Fluid flow is illustrated entering the production screen assembly 120 from the annulus. FIG. 18 illustrates the system shown in FIG. 17 in which the lower zone has been isolated and an upper zone is being treated. FIG. 19 illustrates selective production from a lower zone for the completion system illustrated in FIGS. 16-18.

It will be appreciated that running in an embodiment of the production assembly 108 on production tubing rather than on a workstring/service tool may be desired in certain environments such as when one or more control line components are used in the completion system 100. Production tubing run-in allows easier and more reliable control line connections and effectively eliminates the detailed and complex control line connection at the production packer. Also, these embodiments help to minimize formation exposure time. It will be appreciated that the entire completion system 100 may operated with control lines, thereby eliminating the need for primary operation with a service tool. If desired, back-up or emergency operation of the control line completion system with a service tool may be provided.

Returning to a more general discussion of various embodiments incorporating aspects of the disclosed inventions, those persons of skill in the art having benefit of this disclosure will appreciate that the original service tool position may be known from the original service tool dimensional space out. For example, for those embodiments utilizing down-to-open sleeve valve designs, the open-only shifting profile or tool may be, for example, about 21 to about 23 feet below the lowermost sleeve and the closing profile may be about 3 to about 5 feet below the sleeve. A preferred distance between the opening and closing tools is 18 feet. Thus, the opening tool may be about 18 feet plus about 3 to about 5 feet below the lowermost sleeve. To open the sleeve, the shifting tool can be raised to a position somewhere above the sleeve. Downward movement of the shifting tool through the sleeve will open the sleeve. To prevent closing of the sleeve, the operator need only insure that the closing shifting tool does not move below the sleeve. The preferred spacing allows about 18 feet of movement before the closing tool reaches the sleeve. Preferred operations comprise raising the open-only shifting tool up about 3 feet to about 5 feet above the sleeve, and dropping it down about 3 to about 5 feet below the sleeve to open it. Hydraulic verification of an opened sleeve valve may be obtained by closing the annulus and pumping down the tubing to insure communication with the perforations.

The upper gravel pack position may be found by locating the autolocater profile attached to the top of the service tool in the autolocater collet located just above the isolation packer. Preferably, the autolocater collet provides a significant, for example, about 15,000 to about 20,000 lb. overpull indication when engaged by the autolocater profile. It is preferred that this is the only point that moving the service tool through the assembly will register a significant weight increase at surface. This weight increase may occur as the indicator profile engages the corresponding profile on the autolocater collet fingers. Once the designed overpull is exceeded, the profile may snap through and will continue moving upward. This tool position may, and preferably should be, verified by comparing the indicating point with pipe figures. Once the profile has been pulled through the collet, downward movement may allow the profile to push the autolocater collet downward causing it to move to a supported position. This may create a temporary restriction allowing the collet profile to shoulder against the top of the collet and support set down weight. Picking up again about 2 to 3 feet and then slacking off indexes the autolocater collet to an unsupported position allowing the service tool profile to pass through.

To place the system in the Frac position, the tool may be picked up until about a 5,000 to about 8,000 lb overpull is noted at surface. This overpull may be used to verify engagement of the profile with the collet. Slack off weight may then be applied to insure that the collet is in the supported position. If there is doubt as to the service tool position, upward pull may be applied to the tool. If the tool is in the correct position, an overpull of about 15,000 to about 20,000 lb should be required. If the tool is incorrectly positioned, there should be no little to not overpull required when picking up. The tool may be recycled as necessary to insure proper positioning.

One in this position, the service tool preferably straddles the inverted seals above the packer and below the closing sleeve thereby effectively isolating the slurry port across from the Frac closing sleeve. Tubing pressure may now be used to test the packer, inverted gravel pack seals, service tool condition, and Frac sleeve seals. The profile and collet may support set down weights in excess of about 100,000 lbs making them suitable for use on floating work platforms such as drill ships or semi-submersibles.

To open the Frac sleeve, the open only tool may be pulled above the sleeve and moved back down through it. This is preferably accomplished by straight pickup and set down movements. The approximate distance from the autolocater profile to the autolocater collet may be, and preferably is, known as well as the distance from the autolocater collet to the closing sleeve. For example, the service tool may be picked up about 48 feet to place the open-only tool about 3 feet to about 5 feet above the Frac sleeve. The tool is then moved back down and cycled back to the Frac position, thereby opening the sleeve. This opened condition may be hydraulically verified by pumping down the tubing and either taking returns up the annulus or pumping into the formation.

To locate the reverse position, the tool may be picked up about 8 feet to about 10 feet to place the slurry port above the top inverted seals. The lower section of the service tool preferably remains across the Frac sleeve keeping it isolated during reversing operations. This position may be hydraulically verified by pumping down the annulus and monitoring returns up the tubing.

To close a sleeve, the closing shifting tool should be pulled upwards through the sleeve profile. The service tool may be run back down until it is below the lowest sleeve top being closed. Closing is accomplished by simply moving the service tool slowly through the sleeve. To verify hydraulically sleeve closure, the annulus may be closed and fluid pumped down the tubing to test the system pressure integrity against the formation.

To open the lower screen-wrapped sleeve in the next proximal zone, the autolocater indication point may be used as a reference to determine the service tool position. Preferably, the lower screen-wrapped sleeve will be positioned about 3 feet to about 5 feet from the top of the autolocater. Picking up the service tool abut 55 feet should place the opening tool above the sleeve. The service tool can then be moved down, preferably about 10 feet to open the sleeve. The service tool may then be picked up to the next convenient connection break to allow pressure testing. Dimensional space out is not critical as the preferred 18 feet spacing between the opening and closing shifting tools allows a large range of movement while still correctly functioning the sleeve.

Embodiments utilizing some or all of the disclosed inventions may be designed for simple, user-friendly operation. For example, tool positioning for treatment may be easily mechanically identified and hydraulically verified as described above. Position may be maintained by simple application of set down weight. A preferred, simplified operational procedure may comprise: 1) Set sump packer; 2) Perforate one or more zones as needed; 3) Make up and pressure test each production zone assembly and service tool at rig floor; 4) Run the assembly to bottom on a work string or production tubing and locate on sump packer; 5) Set top production/gravel pack packer; 6) Release service tool if assembly run in on work string, or run in service tool; 7) Open lower zone screen wrapped production sleeve and test; 8) Locate Frac/gravel pack position and set lower zone isolation packer; 9) Open lower zone Frac pack sleeve and locate Frac/gravel pack position; 10) Frac lower zone; 11) Pick up and reverse out; 12) Close all lower zone sleeves; 13) Pressure test for isolation; 14) Begin next zone by opening lower zone screen wrapped production sleeve and test; 15) Repeat steps 8-13 until last zone is completed; 16) Run production seals into upper production packer, if needed (for example, when production assemblies run in on work string); and 17) Open sleeves as needed for production.

The structure, function and use of an embodiment of at least one of the many possible embodiments of an improved completion system according to the present invention has now been disclosed. Other and further embodiments can be devised without departing from the general disclosure thereof. For example, the improved completion system can be used with other well treatment operations, including fracturing, gravel packing, acidizing, water packing, and other treatments. Further, the various methods and embodiments of the improved completion system can be included in combination with each other to produce variations of the disclosed methods and embodiments. Discussion of singular elements can include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intends to protect all such modifications and improvements to the full extent that such falls within the scope or range of equivalent of the following claims.

What is claimed is:

1. A method of completing two or more production zones with a well completion system in a single downhole trip, comprising:

assembling a plurality of production zone assemblies, each assembly comprising a production screen assembly having at least one production screen valve;

running in the production assemblies on production tubing;

setting a production packer associated with the production assemblies;

locating a service tool assembly in a lowermost production zone assembly, the tool assembly having a deactivated opening tool that is activated after the tool has passed below a last production screen valve;

cycling the tool assembly within a production zone to index the completion system to a formation treatment condition; and treating the production zone.

2. The method of claim 1, further comprising activating the opening tool.

3. The method of claim 2, further comprising disposing a stop collet assembly in the lowermost production zone assembly, wherein activating the opening tool includes contacting the stop collet assembly with the tool assembly.

4. The method of claim 2, further comprising verifying activation of the opening tool.

5. The method of claim 1, further comprising hydraulically activating the opening tool.

6. The method of claim 1, wherein the formation treatment condition comprises an opened production valve.

7. The method of claim 6, further comprising verifying the formation treatment condition.

8. The method of claim 6, further comprising using a service tool assembly, a coil tubing, or a wire line tool to open a production valve.

9. The method of claim 6, further comprising repositioning the tool assembly below a production valve and moving the tool assembly up hole to close the production valve thereby isolating the associated production zone.

10. The method of claim 9, further comprising verifying isolation of the associated production zone.

11. The method of claim 1, wherein indexing the completion system to a formation treatment condition comprises moving an indexing system associated with the completion assembly relative to an automatic completion system locating assembly profile associated with the service tool assembly.

12. The method of claim 1, wherein indexing the completion system to a formation treatment condition comprises moving an indexing system associated with the service tool assembly relative to an automatic completion system locating assembly profile associated with the completion assembly.

13. The method of claim 1, wherein treating the production zone comprises fracturing the production zone.

14. The method of claim 1, wherein treating the production zone comprises gravel packing the production zone.

15. A method of completing two or more production zones with a well completion system in a single downhole trip, comprising:

assembling a plurality of production zone assemblies, each assembly comprising a production screen assembly having at least one production screen valve;

running in the production assemblies on production tubing;

locating a service tool assembly in a lowermost production zone assembly, the tool assembly having a deactivated opening tool that is activated after the tool has passed below a last production screen valve;

setting a production packer associated with the production assemblies by pressurizing the setting tool;

releasing the service tool assembly from the completion assembly;

cycling the tool assembly within one or more production zones to index the completion system to a formation treatment condition;

treating the one or more production zones; and removing the tool assembly from the well bore.

16. The method of claim 15, further comprising using a service tool assembly, a coil tubing, or a wire line tool to open one or more production valves.

17. The method of claim 16, further comprising providing production from one or more production zones.

18. The method of claim 15, further comprising opening two or more production valves and using a selective profile system to provide simultaneous non-commingled production from multiple production zones.

19. A method of completing two or more production zones with a well completion system in a single downhole trip, comprising:

assembling a plurality of production zone assemblies, each assembly comprising a production screen assembly having at least one production screen valve;

locating a service tool assembly in a lowermost production zone assembly, the tool assembly having a nosepiece and a deactivated opening tool that is activated after the tool has passed below a last production screen valve;

assembling a production packer assembly comprising a setting tool to the production zone assemblies;

running in the production assemblies on production tubing;

setting a production packer associated with the production assemblies;

assembling a pressure test assembly having a sealing device to the lowermost production zone assembly to form a completion assembly;

performing a completion system pressure test;

deactivating the pressure test assembly;

cycling the tool assembly within a production zone to index the completion system to a formation treatment condition; and treating the production zone.

20. The method of claim 19, wherein deactivating the pressure test assembly comprises using the nosepiece of the tool assembly to remove the sealing device from the pressure test assembly.

* * * * *